US011154120B2

(12) United States Patent
Rawstron

(10) Patent No.: US 11,154,120 B2
(45) Date of Patent: Oct. 26, 2021

(54) SLIDE FASTENER

(71) Applicant: YKK Corporation, Tokyo (JP)

(72) Inventor: Matthew Rawstron, Runcorn (GB)

(73) Assignee: YKK Corporation, Tokyo (JP)

( * ) Notice: Subject to any disclaimer, the term of this patent is extended or adjusted under 35 U.S.C. 154(b) by 28 days.

(21) Appl. No.: 16/534,461

(22) Filed: Aug. 7, 2019

(65) Prior Publication Data

US 2020/0054102 A1 Feb. 20, 2020

(30) Foreign Application Priority Data

Aug. 14, 2018 (GB) ..... 1813246

(51) Int. Cl.

| | |
|---|---|
| ***A44B 19/24*** | (2006.01) |
| ***A44B 19/38*** | (2006.01) |
| ***A44B 19/18*** | (2006.01) |
| ***A44B 19/34*** | (2006.01) |

(52) U.S. Cl.

CPC ..... *A44B 19/382* (2013.01); *A44B 19/18* (2013.01); *A44B 19/34* (2013.01)

(58) Field of Classification Search

CPC ..... A44B 19/382; A44B 19/34; A44B 19/18
See application file for complete search history.

(56) References Cited

U.S. PATENT DOCUMENTS 2,889,605 A * 6/1959 Morin ..... A44B 19/38 24/382
4,350,375 A * 9/1982 Bako ..... A44B 19/301 24/386
4,485,534 A * 12/1984 Pilie ..... A41D 13/00 24/382
5,031,944 A * 7/1991 Keyaki ..... A44B 19/301 292/307 R
5,136,864 A * 8/1992 Spiekermann ..... A44B 19/301 70/312
5,557,954 A * 9/1996 Ling ..... E05B 37/12 70/312
5,697,130 A * 12/1997 Smith ..... A44B 19/38 24/381
6,981,282 B2 * 1/2006 Marty ..... A41D 10/00 2/69
7,073,233 B2 * 7/2006 Leva ..... A44B 19/26 24/386
7,516,523 B2 * 4/2009 Okot ..... A44B 19/262 24/382

(Continued)

OTHER PUBLICATIONS

Search Report, British Patent Application No. 1813246.4, dated Jan. 16, 2019, 4 pages.

*Primary Examiner* — Jason W San
(74) *Attorney, Agent, or Firm* — Kilpatrick Townsend & Stockton LLP

(57) ABSTRACT

A slide fastener includes first and second stringers, an intermediate body, a first slider, and a second slider. The first and second stringers are separated by a first lateral distance in a first longitudinal portion, the first and second stringers are separated by a second lateral distance in a second longitudinal portion. A transition portion extending along at least a portion of a longitudinal extent of the intermediate body interposes the first and second longitudinal portions, and the second lateral distance is greater than the first lateral distance.

14 Claims, 7 Drawing Sheets

(56) References Cited

U.S. PATENT DOCUMENTS

| | | | | |
|---|---|---|---|---|
| 8,484,764 | B2 * | 7/2013 | Damon | H01F 7/0252 2/96 |
| 2003/0066170 | A1 * | 4/2003 | Huang | A44B 19/301 24/387 |
| 2004/0055118 | A1 * | 3/2004 | Marty | A44B 19/00 24/382 |
| 2004/0237605 | A1 * | 12/2004 | Lin | A44B 19/301 70/68 |
| 2008/0229554 | A1 * | 9/2008 | Payne | G09F 23/00 24/418 |
| 2010/0170306 | A1 * | 7/2010 | Fong | E05B 37/02 70/57 |
| 2012/0042433 | A1 * | 2/2012 | Damon | A41F 1/00 2/69 |
| 2015/0374075 | A1 * | 12/2015 | Smith | A44B 19/30 24/418 |
| 2017/0095041 | A1 | 4/2017 | Esposito et al. | |
| 2019/0142116 | A1 * | 5/2019 | Cheng | A44B 19/26 24/389 |
| 2020/0022466 | A1 * | 1/2020 | Baschak | A44B 19/30 |

* cited by examiner

SLIDE FASTENER

CROSS REFERENCE TO RELATED APPLICATIONS

This application is based on United Kingdom Patent Application (No. 1813246.4) filed on Aug. 14, 2018, the contents of which are incorporated herein by way of reference.

BACKGROUND

The present invention relates to a slide fastener. In particular, the slide fastener comprises an intermediate body. The invention also relates to an article including such a slide fastener, and to a method of manufacturing the slide fastener.

Conventional slide fasteners comprise a pair of stringers and an opening and closing means commonly referred to as a slider. Each stringer comprises a tape and a plurality of coupling elements. The coupling elements extend along a first edge of each tape and when the slider of the slide fastener has been moved to a closed position, corresponding coupling elements of the stringers interdigitate, or interlock. When each tape of the slide fastener is attached to separate portions of an article, the separate portions of the article may be releasably joined by closing the slide fastener by moving the slider to the closed position, and thereby bringing the coupling elements into said interdigitating relationship.

Slide fasteners are therefore both useful and versatile and are employed in a range of applications including garments, furnishings and luggage.

Known slide fasteners (also referred to as zip fasteners) are generally constructed as follows.

A coupling portion, usually in the form of a plurality of coupling elements (also referred to as teeth) is attached to a first edge of a tape to form a stringer. The tape is usually woven or knitted and may be formed from, for example, polyester. The coupling elements may be attached to the tape by, for example, crimping or moulding the coupling elements onto a reinforced edge of the tape, which may be referred to as a cord. Alternatively, the coupling elements may be formed as a continuous coil. In this case the coupling elements are most commonly stitched to a surface of the tape at the edge of the tape or, alternatively, are woven or knitted into the tape.

The invention discussed in more detail below is of most use in combination with a slide fastener of the type which includes a plurality of separate coupling elements (as opposed to coils). However, it may be used in combination with a slide fastener of the type which includes a plurality of coupling elements formed as a continuous coil.

Two stringers are brought together, such that the coupling elements of each stringer can attach to one another, for example, by interdigitating, to form a chain. The chain is generally planar, and the chain (and the coupling elements which form part of the chain) extends along a longitudinal axis. A slider is mounted to the chain onto coupling elements of each respective stringer such that it can move along the chain between the two stringers.

The slider commonly includes a main body through which the coupling elements of each stringer pass and a pull tab attached to the main body which may be grasped by a user in order to effect movement of the slider along the chain.

Movement of the slider along the chain in a first sliding direction causes the coupling elements of the first stringer to attach to the coupling elements of the second stringer. When the slider is no longer able to couple elements, or move, any further in the first sliding direction i.e. substantially all the coupling elements of the first stringer are attached to substantially all the coupling elements of the second stringer, the slide fastener may be said to be in a fully closed configuration. Movement of the slider along the chain in a second sliding direction, opposite to the first sliding direction, causes the coupling elements of the first stringer to detach from the coupling elements of the second stringer. When the slider is no longer able to uncouple elements, or move, any further in the second sliding direction i.e. substantially all the coupling elements of the first stringer are detached from the coupling elements of the second stringer, the slide fastener may be said to be in a fully open configuration. Typically, the slider is no longer able to uncouple elements, or move, when the slider abuts a stop of some variety, such as a bottom stop.

The chain is cut to a desired length to form a desired length of slide fastener. Stops (often referred to as top stops and bottom stops) may be attached to either end of the chain. The stops limit the extent of movement that the slider can undertake along the chain. It is usually the case that a top stop limits movement of the slider in the first sliding direction, and a bottom stop limits movement of the slider in the second sliding direction. Typically, stops are required in order to limit the movement of the slider along the chain.

Some slide fasteners may have a single bottom stop which is attached to both the first and second stringers. Other slide fasteners, which may be referred to as separating slide fasteners, may have two separate bottom stops each attached to a corresponding one of the stringers. The two bottom stops may take the respective forms of a retainer box and an insertion pin. The insertion pin can be inserted into the retainer box in order to attach the first and second stringers to one another. Conversely, the insertion pin can be removed from the retainer box when the slider is located adjacent the retainer box in order to pass through the slider and detach the first and second stringers from one another.

Some slide fasteners may have two separate top stops, each being attached to a corresponding one of the stringers. Other slide fasteners may have a single top stop attached to one or both of the stringers.

It is known to provide a body, such as an intermediate body, which, part way along the length of each of the stringers, interposes the stringers and coupling elements attached thereto. In such a case, one or more sliders either pass over the intermediate body or, two sliders, one disposed above the intermediate body and one below, are provided to couple and uncouple the elements either side of the intermediate body. In examples of the latter arrangement, the intermediate body defines a lower and an upper limit of travel for each of the two sliders disposed above and below the intermediate body respectively. The intermediate body also permanently affixes the stringers to one another, owing to the attachment of the intermediate body to each of the two stringers.

SUMMARY

According to a first aspect of the present invention, there is provided a slide fastener comprising:

first and second stringers, each of the first and second stringers comprising a tape and first and second spaced sets of coupling elements disposed along two spaced portions of an edge of the tape, each set of coupling elements having a pitch spacing;

an intermediate body fixedly attached to both the first stringer and the second stringer, the intermediate body interposing the two portions of each edge of the tapes of the first and second stringers;

a first slider being traversable along a longitudinal axis along a first of said two spaced portions of each of the edges of the tapes, movement of the first slider in a first direction being configured to cause the coupling elements disposed along the first portion of each of the edges of the tapes to interdigitate with one another;

a second slider being traversable along the longitudinal axis along a second of said two spaced portions of each of the edges of the tapes, movement of the second slider in the first direction being configured to cause the coupling elements disposed along the second portion of each of the edges of the tapes to interdigitate with one another; and wherein the first and second stringers are separated by a first lateral distance in a first longitudinal portion, the first and second stringers are separated by a second lateral distance in a second longitudinal portion, and a transition portion extending along at least a portion of a longitudinal extent of the intermediate body interposes the first and second longitudinal portions, and the second lateral distance is greater than the first lateral distance.

The first and second stringers may diverge in a lateral direction in the transition portion.

A maximum longitudinal extent of the intermediate body may be greater than or equal to a distance equal to five pitch spacings.

The intermediate body may include at least one cavity, said at least one cavity exposing a cord of at least one of the tapes.

The intermediate body may include a plurality of cavities, said cavities exposing cords of the tapes of both the first stringer and the second stringer.

The intermediate body may include at least two mounting projections, at least one mounting projection being received by a corresponding aperture of the tape of the first stringer, and at least one mounting projecting being received by a corresponding aperture of the tape of the second stringer.

The intermediate body may include a laterally recessed portion.

At least two of the mounting projections may be at least partially disposed in shoulder portions of the intermediate body.

The intermediate body may include a first end configured to abut a lower portion of the first slider, and the intermediate body may include a second end configured to abut an upper portion of the second slider.

The second end of the intermediate body may include a groove in which at least part of a diamond of the second slider is receivable.

First and second tabs may extend in a longitudinal direction from the second end of the intermediate body, and the first and second tabs may be configured to engage flanges and/or a diamond which define corresponding openings in the second slider.

The first and second tabs may have a reduced thickness relative to the rest of the intermediate body, the reduced thickness preferably being substantially equal to a thickness of the coupling elements of the second spaced set of coupling elements.

The intermediate body may be manufactured from a material which has a lower Young's modulus value than that of a material from which the coupling elements are manufactured.

The slide fastener may include two or more intermediate bodies.

An article including the slide fastener may be provided.

According to a second aspect of the present invention, there is provided a method of manufacturing a slide fastener, the method including the steps of:

a) positioning, on a lower die, tapes of first and second stringers relative to one another such that a separation between cords disposed at edges of the first and second stringers is a first distance in a first longitudinal portion, a second distance, greater than the first distance, in a second longitudinal portion, and varies with longitudinal position in a transition portion disposed between the first and second longitudinal portions;

b) bringing an upper die into abutment with the lower die, the upper die and lower die thereby defining a mould cavity, at least one of the upper die and the lower die comprising one or more projections which project into and thereby define a part of the mould cavity, distal ends of the one or more projections abutting and pinching at least the cords of the first and second stringers to thereby secure the cords in position;

c) injecting a molten material into the mould cavity, the material thereby filling the mould cavity other than a portion of the mould cavity obscured by the one or more projections, to define an intermediate body, wherein at least a portion of the intermediate body is formed within the transition portion;

d) the molten material cooling to form the intermediate body; and e) removing the upper and/or lower die such that the intermediate body comprises cavities where the one or more projections were disposed.

The first and second stringers may diverge in a lateral direction in the transition portion.

A maximum longitudinal extent of the intermediate body may be at least equal to five pitch spacings of coupling elements of the first and second stringers.

The one or more projections may be pins.

The lower die may include a lower cavity and the upper die comprises an upper cavity, and the one or more projections may align the tapes of the first and second stringers such that the tapes are disposed substantially equidistantly from outermost points of each of the upper and lower cavities defined by the upper die and the lower die respectively.

Upon injection of the molten material, the molten material may pass through, and thereby fill, apertures disposed in the tapes of the first and second stringers, said material, upon cooling, thereby forming mounting projections which penetrate corresponding apertures in the tapes to secure the intermediate body thereto.

The positioning of the tapes of first and second stringers on the lower die may include the steps of:

i) aligning innermost coupling elements of each of the first and second stringers with a corresponding recess in the lower die; and ii) urging the first and second stringers into the lower die such that the innermost coupling elements are received by the corresponding recesses.

According to a third aspect of the present invention, there is provided a slide fastener including:

first and second stringers, each of the first and second stringers comprising a tape and first and second spaced sets of coupling elements disposed along two spaced portions of an edge of the tape, each set of coupling elements having a pitch spacing;

an intermediate body fixedly attached to both the first stringer and the second stringer, the intermediate body interposing the two portions of each edge of the tapes of the first and second stringers;

a first slider being traversable along a longitudinal axis along a first of said two spaced portions of each of the edges of the tapes, movement of the first slider in a first direction being configured to cause the coupling elements disposed along the first portion of each of the edges of the tapes to interdigitate with one another;

a second slider being traversable along the longitudinal axis along a second of said two spaced portions of each of the edges of the tapes, movement of the second slider in the first direction being configured to cause the coupling elements disposed along the second portion of each of the edges of the tapes to interdigitate with one another; and wherein a maximum longitudinal extent of the intermediate body is greater than or equal to a distance equal to five pitch spacings.

DETAILED DESCRIPTION OF EXEMPLIFIED EMBODIMENTS

A possible problem for existing slide fasteners of the type including an intermediate body is that the incorporation of the intermediate body may lead to the sliders becoming stuck, or jamming, in use. Existing intermediate bodies may also allow fluid to leak between the intermediate body and the sliders to an unacceptable degree. This can be of particular importance when the intermediate body forms part of a fluid-tight slide fastener. Furthermore, existing intermediate bodies can be difficult to manufacture, owing to the manipulation of the tapes which is required in order to correctly align the tapes with respect to one another when incorporating the intermediate body with the slide fastener.

The present invention overcomes one or more of the disadvantages associated with existing slide fasteners, whether mentioned above or otherwise. The present invention also provides an alternative design of slide fastener.

Figure 1:
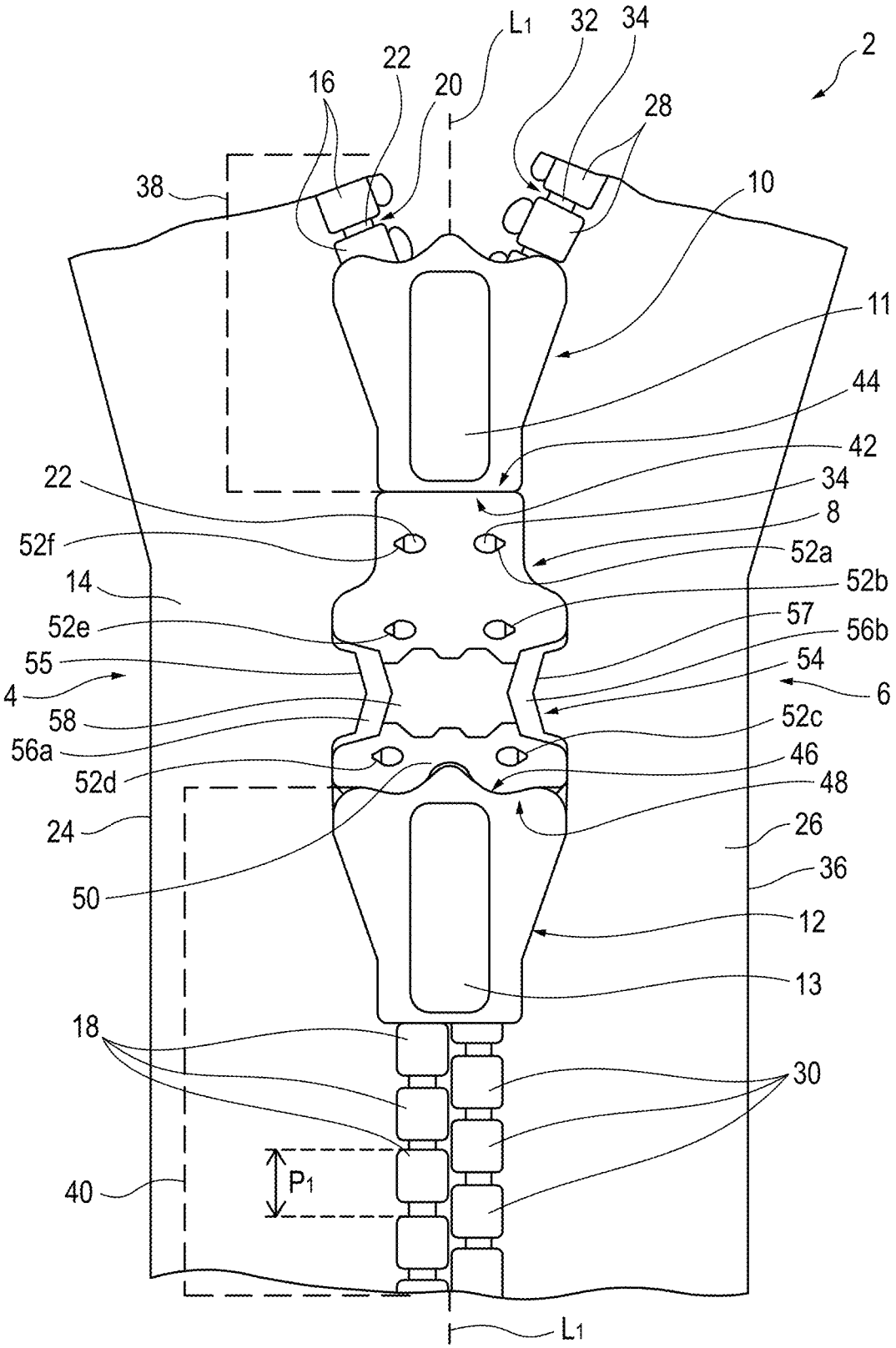
FIG. 1 shows a schematic view of a portion of a slide fastener, according to an embodiment of the invention, from above.

FIG. 1 illustrates a portion of a slide fastener 2 when viewed from above. Slide fastener 2 comprises a first stringer 4, a second stringer 6, an intermediate body 8, a first slider 10 and a second slider 12.

The first stringer 4 comprises a tape 14 to which other components constituting the first stringer 4 are attached. Said other components include a first set of coupling elements 16 (only some of which are visible in FIG. 1, and only some of which are labelled with the numeral 16). Said other components also includes a second set of coupling elements 18 (only some of which are visible in FIG. 1, and only some of which are labelled with the numeral 18). Optionally, a top stop (not shown in FIG. 1) may be attached to an upper end of the first tape 14. Similarly, optionally, a bottom stop (again not illustrated in FIG. 1; e.g. a pin or box) may be attached to a lower end of the first tape 14.

The first and second sets of coupling elements 16, 18 are attached to the tape 14 along a first edge 20. Specifically, the first and second sets of coupling elements 16, 18 are attached to a cord 22 of the tape 14 which defines the first edge 20. An opposing, second edge 24 of the tape 14 may be secured to a garment or other article to which the first stringer 4 is attached.

The second stringer 6 shares many features in common with the first stringer 4. In particular, the second stringer 6 comprises a tape 26 to which first and second sets of coupling elements 28, 30 (only some of which may be visible and/or labelled in FIG. 1) are attached along a first edge 32. Like that described in connection with the first stringer 4, a top and/or bottom stop may be included, and the first and second sets of coupling elements 28, 30 are specifically attached to a cord 34 of the tape 26. Again, like that described in connection with the first stringer 4, a second edge 36 of the second stringer 6 opposes the first edge 32. Tape 26 of the second stringer 6 may be attached to an article, such as a garment, at the second edge 36.

In FIG. 1, the first and second sets of coupling elements 16, 18 of the first stringer 4 may be described as spaced sets of coupling elements. This is owing to the fact that the intermediate body 8 is positioned between the respective sets of coupling elements 16, 18. This also applies to the first and second sets of coupling elements 28, 30 of the second stringer 6. Coupling elements 16, 18, 28, 30 of the slide fastener 2 have a pitch spacing as indicated on the first stringer 4 by the annotation $P_1$. A pitch spacing, or pitch space, $P_1$ is equal to a longitudinal (see discussion of longitudinal axis below) extent of the respective coupling element in combination with a longitudinal offset between said coupling element and the adjacent coupling element of that same stringer. In other words, pitch space $P_1$ is equal to a length of a coupling element combined with a gap between the coupling element and the next or previous coupling element of the stringer 4. The pitch space is measured parallel to the longitudinal axis discussed below.

A longitudinal axis $L_1$ is indicated on the slide fastener 2 in FIG. 1. For reference, the longitudinal axis $L_1$ extends in substantially the same direction as the first and second directions of travel (or sliding directions) of the first and second sliders 10, 12. Put another way, coupling elements 16, 18, 28, 30 of the slide fastener 2 are substantially aligned with the longitudinal axis $L_1$ when closed.

Referring to the first stringer 4, the first set of coupling elements 16 is disposed along a first portion 38 of the edge 20 of the tape 4. Similarly, the second set of coupling elements 18 is disposed along a second portion 40 of the edge 20 of the tape 14. First and second portions 38, 40 are indicated generally by dashed lines, merely to indicate the approximate longitudinal extent of the respective portions 38, 40. Because the first and second portions 38, 40 are spaced apart from one another, again owing to the intermediate body 8 being positioned therebetween, first and second portions 38, 40 may be described as spaced portions.

The aforementioned description with reference to the first second and second portions 38, 40 of the first stringer 4 is also equally applicable to the second stringer 6. That is to say, and although not indicated in FIG. 1, the first and second sets of coupling elements 28, 30 of the second stringer 6 are disposed along first and second spaced portions of the edge 32 of the tape 26.

It will be appreciated that the slide fastener 2 in FIG. 1 is only shown in part. That is to say, upper and lower ends of the first and second stringers 4, 6 are not shown for ease of illustration. As such, the first and second portions 38, 40 are only intended to be generalised indicators. It will be appreciated that the respective portions would, in practice, span the required length of the respective stringer so as to encompass all of the relevant coupling elements between respective distal ends of the sets of coupling elements 16, 18, 28, 30 and the intermediate body 8.

The first slider 10 is traversable along the first portion 38 of the first stringer 4 between the intermediate body 8 and an upper limit (not shown in FIG. 1, possibly defined by a top stop). Likewise, first slider 10 is traversable along the first portion of the second stringer 6 between the intermediate body 8 and an upper limit (not shown in FIG. 1, possibly defined by a top stop). The first slider 10 is traversable in a longitudinal direction. The longitudinal direction is parallel to the longitudinal axis $L_1$ as described above. The first slider 10 comprises a generally Y-shaped channel, or guide, configured to receive and move along the first respective sets of coupling elements 16, 28 of each of the first and second stringers 4, 6. In other words, the Y-shaped channel or guide generally converges moving from an upper end towards a lower end.

Movement of the first slider 10 in the longitudinal direction opens or closes the first portion 38 of the slide fastener 2. In more detail, as the first slider 10 moves upwards (in the orientation shown in FIG. 1), i.e. in a direction away from the intermediate body 8, the respective first sets of coupling elements 16, 28 of the first and second stringers 4, 6 interdigitate or interlock. This has the effect that the first stringer 4 and the second stringer 6, and any garment or article attached thereto, are releasably secured to one another in a region which generally corresponds to the longitudinal extent of the first portion 38.

Conversely, as the first slider 10 moves downwards (in the orientation shown in the Figure), i.e. in a direction towards intermediate body 8, the respective first sets of coupling elements 16, 28 of the first and second stringers 4, 6 respectively decouple or separate. This has the effect that the first stringer 4 and the second stringer 6, and any garment or article attached thereto, are released from one another in a region generally corresponding with the longitudinal extent of the first portion 38.

The first slider 10 further comprises a bridge 11. The bridge 11 defines an outermost extent of the first slider 10 in a direction perpendicular to, and out of, a plane of the first slider 10 (the plane being substantially parallel to the tapes 14, 26). The bridge 11 defines a space (not visible) through which a puller (not shown) is received. The puller is a feature by which the first slider 10 is gripped, and manipulated, by a user. Like the first slider 10, the second slider 12 also comprises a bridge 13, which defines a space (not visible) through which a corresponding puller (not shown) is received.

The above description regarding the direction of the first slider 10 and the resulting effect on the first sets of coupling elements 16, 28 also applies equally to the second slider 12 and the respective second sets of coupling elements 18, 30 in the second portion 40. However, it will be appreciated whilst in relation to the first sets of coupling elements 16, 28, upwards movement corresponds to movement away from the intermediate body 8, in relation to the second sets of coupling elements 18, 30, upwards movement corresponds to movement towards the intermediate body 8. Likewise, whilst in relation to the first sets of coupling elements 16, 28, downwards movement corresponds to movement towards the intermediate body 8, in relation to the second sets of coupling elements 18, 30, downwards movement corresponds to movement away from the intermediate body 8.

As will be observed from FIG. 1, movement of either of the first and second sliders 10, 12 respectively has the same effect upon the respective sets of coupling element 16, 28, 18, 30 of the respective first and second portions 38, 40. That is to say, movement of the first slider 10 upwards interdigitates the first sets of coupling elements 16, 28, and movement of the second sliders 12 upwards interdigitates the coupling elements of the second set of coupling elements 18, 30 of the second portion 40. Likewise, movement of the first slider 10 downwards decouples the first sets of coupling elements 16, 28, and movement of the second sliders 12 downwards decouples the coupling elements of the second set of coupling elements 18, 30 of the second portion 40.

A lower limit of travel of the first slider 10 is defined by the intermediate body 8. Specifically, the intermediate body comprises a first end 42 which is configured to abut a lower portion 44 of the first slider 10. When the first slider 10 is in the position in which it abuts the intermediate body, this may be referred to as the fully open position/configuration of the first slider. As mentioned above, an upper limit of travel of the first slider 10 (or fully closed position/configuration of the first slider) may be defined by a top stop (not illustrated in FIG. 1). However, in alternative arrangements a further intermediate body may define an upper limit of travel of the first slider 10.

In place of a top stop and/or bottom stop, one or more further intermediate bodies may instead be attached to the first and second tapes 14, 26. In such arrangements, further sets of coupling elements, and sliders therefor, may be incorporated beyond said one or more further intermediate bodies. For example, the slide fastener could incorporate two intermediate bodies, defining three portions, with a slider traversing each portion. For a slide fastener having N intermediate bodies, the slide fastener may have N+1 portions, N+1 spaced sets of coupling elements and N+1 sliders. The incorporation of multiple intermediate bodies is advantageous for reasons of allowing a user the option of being able to vary, to a greater extent, how much of the slide fastener, specifically the respective spaced sets of coupling elements of the portions thereof, is/are connected/separated. This is particularly advantageous when the slide fastener is used for increasing/reducing the ventilation, or breathability, of a garment to which it is attached. This is described in greater detail below. Connected as used above is intended to mean coupling elements being interdigitated with one another.

In preferred arrangements, a lateral extent of the lower portion 44 of the first slider 10 is substantially equal to that of a lateral extent of the first end of the intermediate body 8.

Lateral is intended to refer to a direction substantially perpendicular to the longitudinal axis $L_1$. The first end 42 of the intermediate body 8 being substantially equal in lateral extent to that of the lower portion 44 of the first slider 10 is advantageous for reasons of improved aesthetics. This arrangement is also beneficial for reasons of reduced material usage, in comparison to an otherwise wider first end 42, or first end 42 having a greater lateral extent. A wider first end 42 could also lead to the intermediate body 8, or more generally the slide fastener 2 of which the intermediate body 8 forms part, catching or snagging on machinery during manufacture of either the slide fastener 2 or an article to which it is attached. A narrower first end 42 may lead to the intermediate body 8 at least partially entering the lower portion 44 of the first slider 10, which could disrupt the coupling mechanism. The abutment of the lower portion 44 of the first slider 10 against the first end 42 of the intermediate body 8 is beneficial because the intermediate body 8 removes the requirement for a bottom stop mechanism which would otherwise be required to define a lower limit of travel of the first slider 10. Fewer required components are desirable for reasons of a reduced stock-holding requirement, along with potential cost and weight savings.

The intermediate body 8 also comprises a second end 46 which is configured to abut an upper portion 48 of the second slider 12. It is advantageous to provide this abutment because doing so alleviates the requirement for further features, such as a top stop mechanism, which would otherwise be required to define an upper limit of travel of the second slider 12. This is advantageous for the reasons explained in the paragraph above in relation to the first slider.

In preferred arrangements, a lateral extent of the second end 46 of the intermediate body 8 is substantially equal to that of a lateral extent of an upper portion 48 of the second slider 12. The upper portion 48 of the second slider 12 may otherwise be referred to as two shoulders of the second slider 12. The substantially equal lateral extent may again be desirable for reasons of improved aesthetics and the other reasons as set out above in connection with the substantially equal lateral extent of the lower portion 44 of the first slider 10 and the first end 42 of the intermediate body 8. The only difference being that, due to the position of the second slider 12, it would be a narrower second end 46 of the intermediate body 8 which could at least partially enter the upper portion 46 of the second slider 12, which could disrupt the coupling mechanism.

In preferred embodiments, as is the case for the currently described embodiment, an upper profile of the upper portion of the second slider 12 has a corresponding shape to a lower profile of the second end 46 of the intermediate body 8. In this way, when the second slider 12 is in the fully closed configuration, in which it abuts the intermediate body 8, the upper profile of the upper portion 48 of the second slider 12 and lower profile of the second end 46 of the intermediate body 8 intermesh. In some embodiments, such intermeshing may be fluid resistant or even fluid-tight. It will be appreciated that such a feature will be particularly relevant if the slide fastener of which the intermediate body and second slider form part is a fluid-tight (e.g. waterproof) slide fastener.

A longitudinal extent of the intermediate body 8, or a length of intermediate body 8, is preferably greater than or equal to five pitch spacings. In other words, the distance defined by $P_1$ multiplied by five corresponds to a minimum length (longitudinally) of the intermediate body 8. Said minimum length has been found to provide a number of advantages. The intermediate body 8 being at least around five pitch spacings in length is preferable in arrangements where the coupling elements are manufactured from plastic, and specifically where the coupling elements are plastic injection moulded coupling elements (as illustrated in the Figures). In arrangements where the coupling elements are of the variety used in coil or metal slide fasteners, and are therefore typically shorter than corresponding plastic coupling elements, it may be preferable that the intermediate body is greater than around 5 pitch spacings in length.

First, the increased length of the intermediate body 8 means that the intermediate body 8 is more flexible. As such, manipulation of the first and second sliders 10, 12 respectively is less likely to result in a jamming or interrupted movement of the respective sliders. This is advantageous for reasons of improved usability and ergonomics. Furthermore, increased flexibility of the intermediate body 8 means that a seal provided between the portions of the first and second sliders 10, 12 respectively in proximity to the intermediate body 8 is comparatively more effective. This means that fluid is less likely to penetrate the slide fastener 2 and therefore come into contact with any entity which, in the FIG. 1 orientation, lies underneath the slide fastener 2 (into the plane of the paper). This is beneficial for reasons of improved fluid-proofing (e.g. waterproofing) and performance.

An alternative way of increasing the relative flexibility of the intermediate body 8 is to manufacture the intermediate body 8 from a more flexible material than that used to manufacture the coupling elements 16, 18, 28, 30. One such way of quantifying the flexibility is the Young's Modulus value of the material. The skilled person will appreciate the Young's Modulus to be a material constant which relates stress to strain, and is indicative of the flexibility of a material. In other words, it is preferable to manufacture the intermediate body 8 from a material which has a lower Young's Modulus than the material from which the coupling elements 16, 18, 28, 30 are manufactured.

A further advantage of the increased length of the intermediate body relates to the angle to which the cords of the tapes passing through the intermediate body are skewed relative to the longitudinal axis. This advantage is discussed in more detail at a later point within this document in connection with FIG. 3.

Five pitch spacings is preferably equal to between around 15 mm and around 17 mm.

There is no strict upper limit of the length, or longitudinal extent, of the intermediate body 8. However, the length of the intermediate body 8 is preferably around 90 pitch spacings or less. If the length of the intermediate body 8 is greater than around 90 pitch spacings, the first and/or second portions 38, 40 of the slide fastener 2 become shorter, which may lead to the function of the slide fastener 2 becoming impaired. This may be for reasons of, for example, there being an insufficient number of coupling elements beyond either end of the intermediate body 8 to allow for smooth slider operation, or passage.

It is preferable that the length of the intermediate body 8 be around 70, 47.5, 35, 30, 15 or 10 pitch spacings, or less.

Defined in a different way, it is preferable that the intermediate body 8 is at least around 15 mm in length and less than around 105 mm in length. In arrangements where the intermediate body is less than or equal to around 105 mm in length, and the coupling elements are of the variety used in coil or metal slide fasteners, 90 pitch spacings, or less, of the coupling elements may be contained within the length of the intermediate body. Put another way, the intermediate body may be less than or equal to around 90 pitch spacings in length.

The second end 46 of the intermediate body 8 incorporates a groove 50. The groove 50 extends in the longitudinal direction, which is a direction collinear with longitudinal axis $L_1$. The groove 50 is configured to receive at least part of a diamond (not visible in FIG. 1, but shown in FIG. 2) of the second slider 12. As shown in FIG. 1, the groove 50 is very similar in geometry to that of the upper end 48 of the second slider 12. That is to say, the groove 50 incorporates a rounded recess. This interaction enables the second slider 12 to more closely abut, or engage, the intermediate body 8. For the reasons explained above, this means that the effectiveness of the seal formed between the second slider 12 and the intermediate body 8 is improved. This is due, at least in part, to the path which any fluid passing through the slide fastener 2 would otherwise need to take, being made more tortuous. In other words, the geometry forms a labyrinth seal of sorts, which improves the effectiveness of the seal.

In other arrangements, the second slider may incorporate a diamond which is positioned further away from the intermediate body when the second slider is in a closed configuration. An upper end of the second slider may therefore be flat, or substantially flat. That is to say, the diamond may not define an uppermost point of the second slider. In such arrangements, it may not be the diamond which is received by a second end of the intermediate body, or a groove thereof, but some other part of the second slider. What is preferable for all arrangements is that one or more portions of the intermediate body are received by openings (described in more detail below) in the second slider and may therefore contact the diamond. For fluid-resistant or fluid-tight slide fasteners, this arrangement can resist, or prevent, the passage of fluid through the slide fastener between the intermediate body and the second slider. This effect is enhanced by providing the one or more portions of the intermediate body at a longitudinally lower position than the respective openings in the second slider (when the second slider is in the closed configuration), to improve the likelihood that contact with the diamond occurs when the second slider is in the closed configuration. In some configurations, portions of the intermediate body may continue below the diamond of the slider, which further increases the resistance to fluid passing between the intermediate body and the slider. This is not required for the first slider, which is able to fully couple lowermost coupling elements in the vicinity of the intermediate body 8, owing to the geometry of the first slider (see FIG. 2). That is to say, coupling elements of the first portions of the first and second stringers can alone provide a sufficient seal, without requiring geometric modification of the intermediate body, when the first slider is in the closed configuration. In particular, when the first slider is in the closed configuration, the coupling elements of the first portions of the first and second stringers completely interdigitate in the region of the first slider to form a seal.

Returning to the intermediate body 8, the intermediate body 8 further comprises a plurality of cavities (or apertures) 52*a-f*. The cavities 52*a-f* extend through the intermediate body 8 such that respective cords 22, 34 of the first and second tapes 14, 26 may be visible in the FIG. 1 view. The cavities 52*a-f* are formed during the manufacture of the intermediate body 8. This will be described in greater detail below. Briefly, the cavities 52*a-f* are formed by projections of a die which pin the cords 22, 34 of the tapes 14, 26 in a correctly aligned orientation during injection moulding of the intermediate body 8. In other words, the projections obscure a portion of a mould cavity of the die, or dies, preventing the injection moulded material from settling in said portion, which leads to the formation of the cavities 52*a-f*. As a result, and due to the mould cavity being obscured by the projections, the cavities 52*a-f* remain unfilled by molten material during manufacture of the intermediate body 8.

Because the cavities 52*a-f* are not filled by molten material, the cavities 52*a-f* enable cords 22, 34 of the first and second tapes 14, 26 to be viewed through the intermediate body 8. This provides a quality control functionality in that if the cords 22, 34 are not visible through the intermediate body 8, then it is likely that the tapes 14, 26 were not correctly aligned during manufacture of the intermediate body 8. As a result, if the tapes 14, 26 were not correctly aligned during manufacture, this may mean that the intermediate body 8 is not correctly aligned, and the slide fastener 2 is not fit for purpose.

The intermediate body interposes the first and second portions 38, 40 of each of the first edges 20, 32 of the first and second tapes 14, 26. The intermediate body 8 is fixedly attached to each of the first and second stringers 4, 6 such that if the first and second sliders 10, 12 were to be removed, the intermediate body 8 would still connect the first stringer 4 to the second stringer 6. Fixedly attached is intended to mean that the intermediate body 8 is, having been manufactured, permanently attached to each of the first and second stringers, 4, 6.

The intermediate body 8 provides the functionality that each of the first and second sliders 10, 12 can be manipulated independently of one another to interdigitate or separate respective sets of first and second sets of coupling elements 16, 28, 18, 30. When the slide fastener 2 is used in conjunction with a garment, for example, this independent manipulation allows the slide fastener 2 to provide a venting functionality without entirely separating the first stringer 4 from the second stringer 6. For example, if used on a coat, the slide fastener 2 could be used to provide a partially venting functionality in the region of the first portion 38, whilst still securing the first stringer 4 to the second stringer 6 in the region of the second portion 40 and the region surrounding the intermediate body 8. Such venting functionality may be particularly useful for garments such as high performance sportswear and/or outdoor clothing.

The intermediate body 8 further comprises a laterally recessed portion 54. Although the reference numeral 54 is shown in FIG. 1 on the side of the second stringer 6, the recessed portion 54 is also intended to refer to the side of the intermediate body 8 on the side of the first stringer 4. As such, the laterally recessed portion 54 is intended to refer to a neck portion of the intermediate body 8, or a narrowing of the intermediate body 8. The laterally recessed portion 54 also increases the flexibility of the intermediate body 8. This is beneficial for the reasons already explained above. The laterally recessed portion 54 comprises first and second recesses 55, 57. The first and second recesses 55, 57 are disposed at the respective sides of each of the first and second stringer 4, 6 on the laterally recessed portion 54.

The laterally recessed portion 54 is defined at least in part by first and second tapered surfaces 56*a*, 56*b*. The first and second tapered surfaces 56*a*, 56*b* form part of the first and second recesses 55, 57 respectively. The first and second tapered surfaces 56*a*, 56*b* are beneficial for reasons of more easily being able to remove the intermediate body 8 from the dies used in its manufacture, once the intermediate body 8 has been manufactured. The first and second tapered surfaces 56*a*, 56*b* extend inwards with respect to the longitudinal axis until they merge with a central portion 58 of the intermediate body. Although not essential, if the laterally recessed portion 54 was not defined by tapered surfaces, edges of the laterally recessed portion 54 would be sharper and may catch on the die when removed therefrom.

Figure 2:
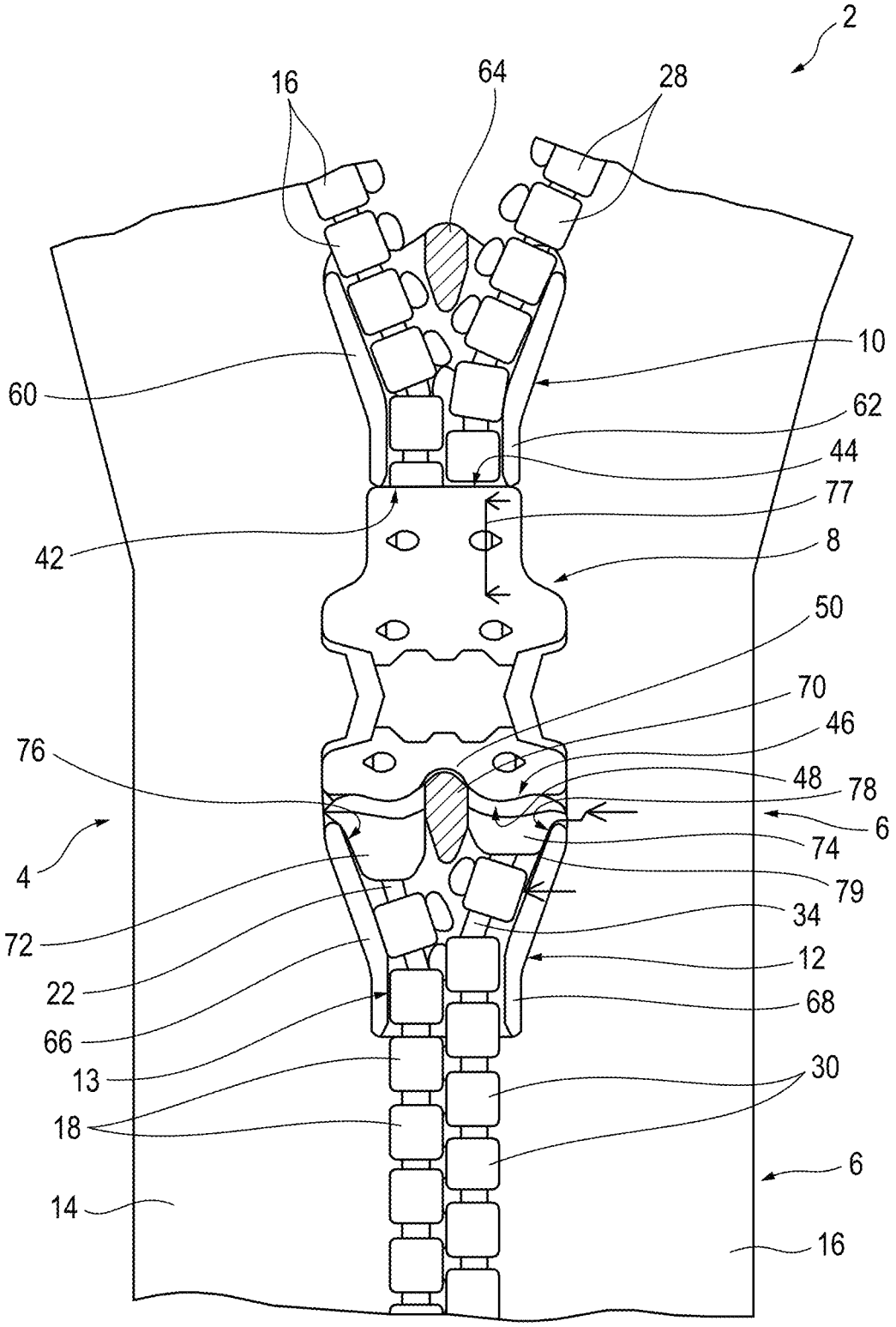
FIG. 2 shows the portion of the slide fastener of FIG. 1, with first and second sliders shown in cross-section.

Referring now to FIG. 2, this figure illustrates the portion of the slide fastener of FIG. 1 but with the first and second slide fasteners 10, 12 shown in a partially cut away section view.

Beginning with the first slider 10, the first slider 10 comprises first and second flanges 60, 62 and diamond 64. The first and second flanges 60, 62 may be referred to as edge arrangements. The diamond 64 and the first and second flanges 60, 62 interact such that upward movement of the first slider 10 causes the first sets of coupling elements, 16, 28 to interdigitate with one another. Conversely, downward movement of the first slider causes decoupling of the first sets of coupling elements, 16, 28. This is well known in the art and will hence not be described in detail for the purposes of this invention.

Of note, the diamond 64 is indicated with a cross-hatched pattern. This is representative of the fact that the diamond 64 spans most of a thickness (perpendicular to the plane of the Figure) of the first slider 10, and so in the view shown in FIG. 2 the diamond 64 is partly cut away. In comparison, the first and second flanges 60, 62 only span a portion of the thickness (perpendicular to the plane of the Figure) of the first slider 10 in order to allow space therebetween for respective tapes 14, 26 to pass, and are therefore not cut away in the FIG. 2 view (and so are not indicated with a cross-hatched pattern). In other words, the view of the slider has been cut along a plane between first and second flanges on upper and lower wings of each slider. The upper wing and upper flanges are above the plane of the page and are thus not shown in FIG. 2.

Like the first slider 10, the second slider 12 also comprises first and second flanges 66, 68 and diamond 70. Once again, the first and second flanges 66, 68 and the diamond 70 of the second slider 12 cooperate such that upward movement of the second slider 12 causes the second sets of coupling elements 18, 30 to interdigitate with one another. Conversely, downward movement of the second slider causes decoupling of the second sets of coupling elements, 18, 30.

FIG. 2 also shows, in more detail, the diamond 70 of the second slider 12 being received by the groove 50 in the second end 46 of the intermediate body 8. Also more visible in FIG. 2, for both first and second sliders 10, 12, is the arrangement of the respective coupling elements 16, 18, 28, 30 of first and second stringers 4, 6 within the first and second sliders 10, 12.

Also visible in FIG. 2 are first and second tabs 72, 74 of the intermediate body 8. The first and second tabs 72, 74 extend from the second end 46 of intermediate slider 8. The first and second tabs 72, 74 engage, that is, enter into, the second slider 12 when the second slider 12 is in an uppermost position (or fully closed position/configuration), as shown in FIG. 2. The slider 12 may be said to have openings defined between the diamond 70 and flanges 66, 68 respectively. The respective openings are indicated generally by reference numerals 76, 78. The first and second tabs 72, 74 are configured to engage with and be received by the openings 76 and 78 respectively. The openings 76, 78 may otherwise be referred to as mouths (of the sliders). The first and second tabs 72, 74 may otherwise be referred to as legs, projections or protrusions.

A thickness of the first and second tabs 72, 74 (in a direction perpendicular to the plane of the figure) is preferably substantially the same as a corresponding thickness of the coupling elements of the respective second sets of coupling elements 18, 30 of the first and second stringers 4, 6 respectively. This is advantageous in that the geometry of the second slider 12 need not be modified in order for the tabs 72, 74 to be received therein.

In preferred arrangements, a longitudinal extent of the first tab 72 is greater than a corresponding longitudinal extent of the second tab 74. As will be observed from FIG. 2, the relative arrangement, or specific alignment, of the coupling elements constituting the second sets of coupling elements 18, 30 gives rise to the differing lengths of the first and second tab 72, 74. For the second set of coupling elements 18 disposed on the first stringer 4, an uppermost coupling element is disposed at a comparatively lower longitudinal position than that of a comparable uppermost coupling element of the second set of coupling elements 30 of the second stringer 6. As such, the first tab 72 has a greater longitudinal extent, or is longer than that of the second tab 74. This ensures that the cord 16 of the first stringer 4 is not without a coupling element or tab for too great a distance (e.g. a distance greater than the longitudinal spacing between two adjacent coupling elements of the second set of coupling elements of the first or second stringer), so as to avoid a risk of the second slider 12 becoming jammed in use. The first and second tabs 72, 74 improve the effectiveness of the seal between the second slider 12 and the intermediate body 8 when the second slider 12 is in the fully closed configuration by creating a more tortuous path through which any fluid has to pass in order to penetrate the slide fastener 2. More broadly, the first and second tabs 72, 74 fill openings 76, 78 of the second slider 12 which would otherwise be empty and may therefore provide a pathway through which fluid could penetrate the slide fastener 2 and may therefore pass through the slide fastener 2.

Figure 5:
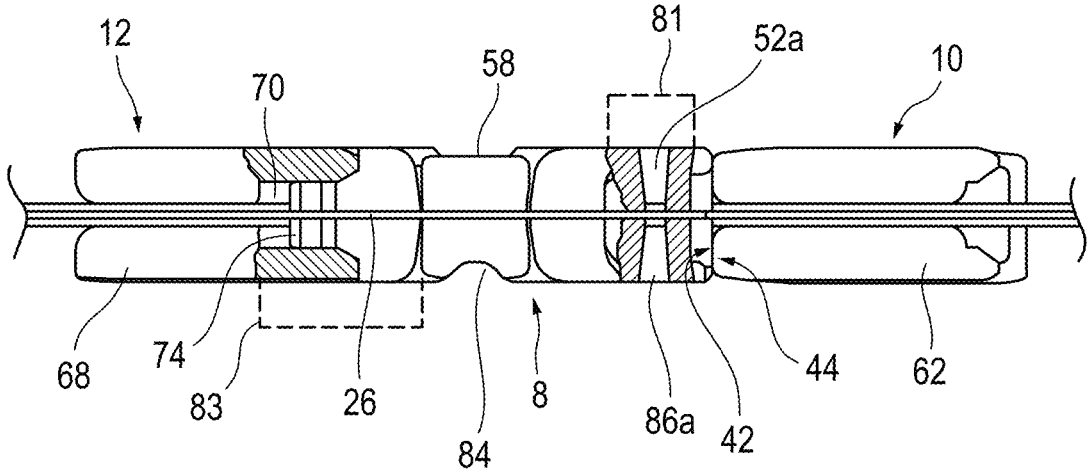
FIG. 5 shows the portion of the slide fastener of FIG. 1 from the side, with a slider and the intermediate body in partial cross-section view, and with coupling elements omitted.

Also indicated in FIG. 2 are two cross-section view lines numbered 77 and 79. These are used to indicate where the cross-section portions of FIG. 5 are taken, and will be described in detail below.

Figure 3:
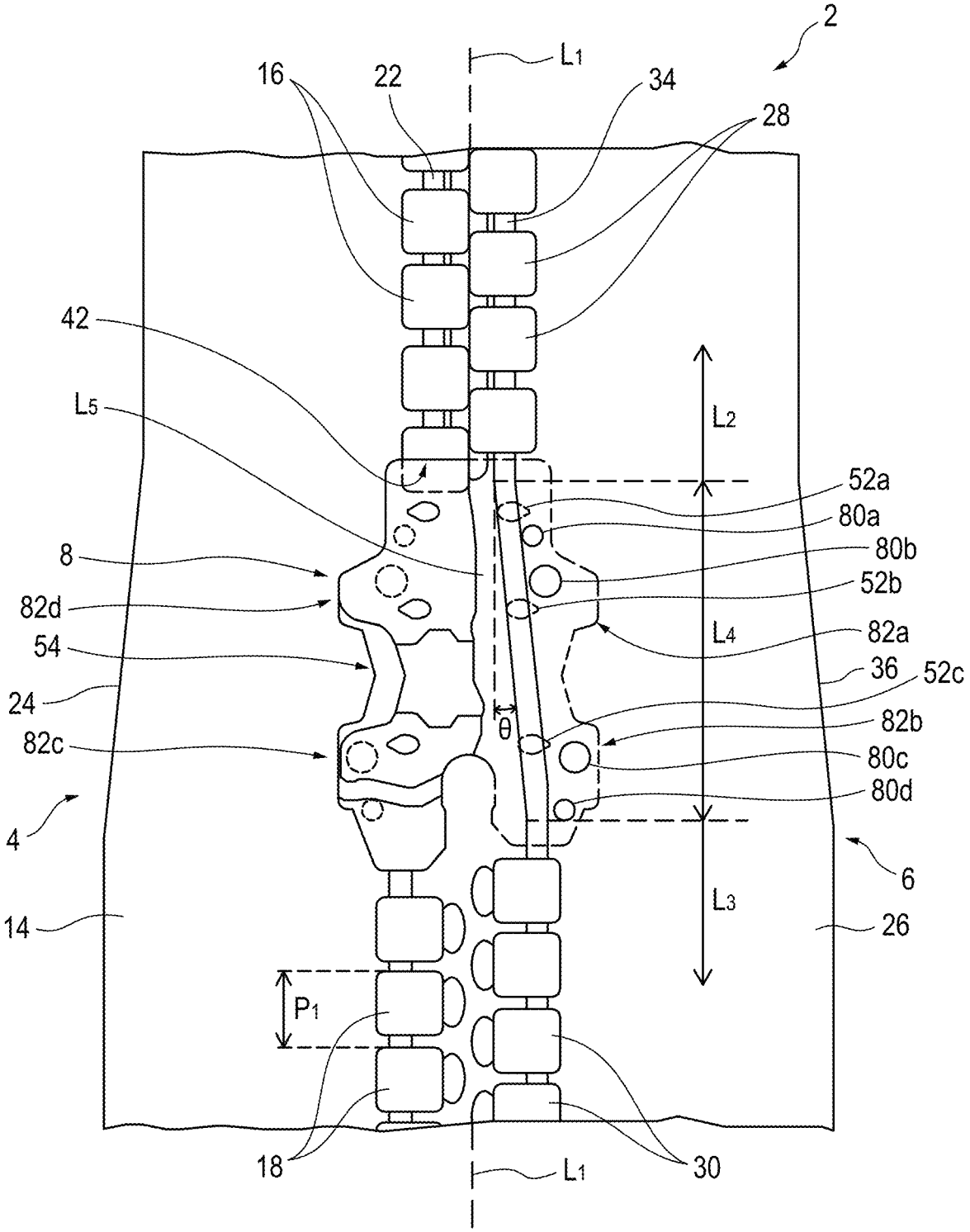
FIG. 3 shows the portion of the slide fastener of FIG. 1 with sliders omitted and a portion of an intermediate body shown in cross-section.

FIG. 3 shows the slide fastener 2 with a portion of the intermediate body 8 shown in a partially cut away view. As such, FIG. 3 shows certain features of the intermediate body 8 which are otherwise not visible in the other figures. It will be appreciated that whilst certain features are described below in relation to the second stringer and a second stringer side of the intermediate member, entirely equivalent features may also be present in relation to the first stringer and a first stringer side of the intermediate member. However, there may also be differences. For example, the angles may differ from one another, and one or more of the cords may be arcuate or follow some other non-linear path in the transition portion.

Due to the partially cut away view of the intermediate body 8, a portion of the tape 26 of the second stringer 6, specifically the cord 34 thereof, and its alignment through the intermediate body 8 can be seen. As will be appreciated from FIG. 3, a separation (perpendicular to the longitudinal axis and within the plane of the slide fastener) between the cords 22, 34 varies depending on the longitudinal position at which the separation is taken. Specifically, the cords 22, 34 are separated by a first distance in a first longitudinal portion $L_2$. $L_2$ corresponds approximately with the first portion 38 as indicated in FIG. 1. A separation between the cords 22, 34 is a second distance in a second longitudinal portion $L_3$. $L_3$ corresponds approximately with the second portion 40 as indicated in FIG. 1. Finally, a separation between the cords 22, 34 varies with longitudinal position in a transition portion $L_4$ which is disposed between the first and second longitudinal portions $L_2$, $L_3$. Said separation varying with longitudinal position may otherwise be referred to as the first and second stringers 4, 6 extending away from each other, or diverging.

Where the separation is said to be a given distance in a longitudinal portion, it will be appreciated that the given distance may vary slightly in view of manufacturing tolerances, and so on. That is to say, the given distance may not be that exact distance throughout that longitudinal extent. Furthermore, the longitudinal portions may not refer to an entire longitudinal extent like that shown in FIG. 3. Instead, the longitudinal portions may only span to the next corresponding coupling element, or pair of coupling elements, in the indicated direction. As such, in some embodiments the transition portion may be defined between coupling elements in closest proximity to the intermediate body, at either end thereof.

Although the cord 22 of the first tape 14 is not visible in the transition portion $L_4$ in FIG. 3, the cord 22 is substantially identical in position to that of the cord 34 of the second tape 26, reflected about a plane into the perpendicular to the plane of the figure and collinear with the longitudinal axis $L_1$.

As best indicated in FIG. 3, owing to the varying relative position of the cords, 22, 34, second edges 24, 36 of the first and second tapes 14, 26 are separated from the longitudinal axis $L_1$ by a varying distance depending on the longitudinal position. That is not to say that the distance varies along every longitudinal position, but instead an offset between the longitudinal axis $L_1$ and each of the second edges 24, 36 is not constant along the longitudinal length of the slide fastener 2.

The cavities 52*a-c* are shown to align with the cord 34 of the second tape 26 of the second stringer 6. Hence, FIG. 3 indicates how the cavities 52*a-c* are formed as a result of projections pinning the cord 34 in a correctly aligned position before the intermediate body 8 is formed. As mentioned above, further detail in this regard will be provided below.

During manufacture, the variation of the separation between the cords 22, 34 requires that the stringers 4, 6 be positioned relative to one another in a correct position before the intermediate body 8 is formed. This is described in more detail in connection with the manufacture of the intermediate body 8 further below.

FIG. 3 also shows apertures 80*a-d* in the tape 26 of the second stringer 6. The apertures 80*a-d* are penetrated by mounting projections (not shown) of the intermediate body 8.

The mounting projections are formed during the manufacture of the intermediate body 8. The purpose of the mounting projections is to penetrate corresponding apertures 80*a-d* in the tape 26 of the second stringer 6 so as to more securely affix the intermediate body 8 to the tape 26. The same applies for the first stringer 4 and the respective tape 14 in relation to corresponding mounting projections in the first stringer side of the intermediate body. Although not clearly visible in FIG. 3, apertures 80*a-d* in the tape 26 receive, or are penetrated by, the mounting projections during manufacture of the intermediate body 8. The combination of the mounting projections and corresponding apertures 80*a-d* in the tape 26, as mentioned above, more securely attaches the intermediate body 8 to the second stringer 6. Because the mounting projections are not normally visible due to their location beneath a front face of the intermediate body 8, said mounting projections are not visible in either of FIGS. 1 and 2.

As will be understood from FIG. 3, the apertures 80*a-d*, and so mounting projections, are disposed in proximity to shoulder portions 82*a-d* respectively of the intermediate body 8. Specifically, and as viewed from above, like in FIG. 3, the mounting projection which penetrates the aperture 80*c* is at least partially disposed in shoulder portion 82*b* of the intermediate body 8. Likewise, the mounting projection which penetrates the aperture 80*b* is at least partially disposed in shoulder portion 82*a* of the intermediate body 8. Corresponding mounting projections (not shown in FIG. 3) on the first stringer 4 side of the intermediate body 8 are disposed in substantially equivalent positions to the mounting projections which penetrate the apertures 80*b*, 80*c* on the second stringer 6 side (i.e. at least partially disposed in shoulder portions 82*c* and 82*d*). That is to say, the intermediate body 8 has like mounting projections on the first stringer 4 side, which correspond with the mounting projections which penetrate the apertures 80*a-d* of the second stringer 6 side reflected about a plane perpendicular to the plane of the figure and collinear with the longitudinal axis $L_1$.

Disposing the mounting projection which penetrates the aperture 80*c* in the shoulder portion 82*b* is advantageous because the shoulder portion 82*b* has a greater lateral extent than the laterally recessed portion 54. This provides more material which can surround the mounting projection, and thereby increases the strength with which the mounting projection is attached to the surrounding material of the intermediate body 8. Furthermore, positioning the mounting projection as indicated in FIG. 3 enables the mounting projection to be located without impinging on the cord 34 which, as will be appreciated from FIG. 3, may otherwise need to be repositioned. Inclusion of the shoulder portion 82*b* allows the corresponding mounting projection to be positioned at a greater lateral distance away from the longitudinal axis $L_1$ than would otherwise be possible to thereby avoid the cord.

The shoulder portions 82*a-d* are laterally wider than the surrounding material of the intermediate body 8. By having the shoulder portions 82*a-d* extend laterally outwards from the intermediate body 8, more material can be provided in which to dispose of at least two of the mounting projections, without unduly decreasing the flexibility of the intermediate body 8. That is to say, the laterally recessed portion 54 can still exist but, due to the shoulder portion 82*b*, the mounting projections which penetrate the apertures 80*b* and 80*c* can be disposed at more preferable positions. For the reasons explained above, maintaining flexibility of the intermediate body 8 is desirable for reasons of improved ergonomics and fluid-proofing (e.g. waterproofing).

Although a specific arrangement of mounting projections and shoulder portions 82*a-d* are indicated in FIG. 3, many other combinations and arrangements are possible. For example, the mounting projection which penetrates the aperture 80*b* could otherwise be disposed more centrally within the shoulder portion 82*a*.

The illustrated aperture 80*b* is disposed in a different lateral position to that of the aperture 80*c* because of the position of the tape 26 in which the aperture is disposed. The apertures 80*b*, 80*c* are created in the tape 26 by a punch. As such, the punch descends upon the tape 26 and thereby removes a portion of the tape 26 to create the apertures 80*b*, 80*c*. When the apertures 80*b*, 80*c* are created, the tape is straight. In other words, the second tape 26 is parallel to the first tape 14. Typically, apertures in both tapes 14, 26 are formed at the same time, by the same punch. However, at the point whereby the intermediate body 8 is to be manufactured, and as will be described in more detail below, the stringers 4, 6, specifically the tapes 14, 26 thereof, are offset from one another at an angle (as shown in FIG. 3). It is this offset which creates the difference in lateral position of the apertures 80*b*, 80*c* in the FIG. 3 illustration. Having a single punch is preferable for reasons of simpler manufacture. Alternative options include a series of double punches, for various sizes of aperture, or to use a machine with a moveable single punch.

As indicated on FIG. 3, in the transition portion $L_4$ the separation between the cords 22, 34 of the first and second tapes 14, 26 respectively varies with longitudinal position along the longitudinal axis $L_1$. In particular, the separation between the cords 22, 34 increases as you move away from the first portion 38 and towards the second portion 40. Due to this variation, an angle θ is developed. The angle θ is the angle between the cord 34 and an axis parallel to the longitudinal axis $L_1$. As such, the angle θ can be considered to be an angle of inclination or a skew angle between the longitudinal axis $L_1$ and the cord 34. The angle θ is the angle by which the first and second stringers 4, 6 each extend away from the longitudinal axis $L_1$ in the transition portion $L_4$. Put another way, the angle 2θ is the angle by which the first and second stringers 4, 6 extend away from each other (or diverge) in the transition portion $L_4$.

Given that the tapes 14, 26 are of a substantially fixed lateral width, as mentioned above, the difference in separation between the cords 22, 34 leads to a variation in the lateral separation of the second edges 24, 36 from the longitudinal axis $L_1$. It will therefore be appreciated that, during manufacture of the intermediate body 8, the tapes 14, 26 must be held in position to achieve the correct skew angle of the cords 22, 34.

The separation between the cords 22, 34 of the first longitudinal portion $L_2$ and the second longitudinal portion $L_3$ is determined by the choice of coupling elements and sliders. Put another way, the separation between the cords 22, 34 of the first longitudinal portion $L_2$ is defined by the distance between the cords, in the lateral direction, when the coupling elements of the first longitudinal portion $L_2$ are interdigitated. By contrast, the separation between the cords 22, 34 of the second longitudinal portion $L_3$ is defined by the distance between the cords 22, 34, in the lateral direction, when upper coupling elements of the second longitudinal portion $L_3$ are located within the upper ends of the Y-shaped channel of the second slider 12 when the second slider 12 is in the fully closed position (as shown in FIG. 2). Upper coupling elements is intended to refer to coupling elements near an uppermost end of the second longitudinal portion $L_3$.

It will therefore be appreciated that if the intermediate body 8 were to be made shorter, i.e. to have a reduced longitudinal extent, in order to maintain the same separation between the cords 22, 34 in the first and second longitudinal portions $L_2$, $L_3$, the angle θ would increase. In other words, the tapes 14, 26 would be skewed to a greater extent. This, in turn, means that the tapes 14, 26 would require more force in order to be pinned down during the manufacture of the intermediate body 8 in order to ensure they remain in the correctly aligned position. Furthermore, even after manufacture of the slide fastener 2 is complete, subsequent attachment of the slide fastener 2 to an article, such as a garment, by second edges 24, 36 is easier for a longer intermediate body 8. This is because a reduced length intermediate body 8 leads to a greater angle θ which, in turn, means there is greater distortion (e.g. kinking) of the tapes 14, 26, specifically in the transition portion $L_4$ and areas bordering the transition portion $L_4$. Put simply, the angle θ reduces as the length of the intermediate body 8 increases. In turn, the greater the angle θ, the more difficult the manufacture of the intermediate body 8 is due to the increased distortion of the tapes 14, 26. In turn, subsequent attachment, i.e. sewing of the slide fastener 2 to an article by second edges 24, 36, is increasingly difficult with greater angles of θ, once again owing to the resulting distortion of the tapes 14, 26. It has been found that only an intermediate body which is at least as long as five pitch spacings $P_1$ leads to a sufficiently small angle θ such that the intermediate body 8 can be manufactured relatively straightforwardly, and such that the slide fastener 2 can readily be attached to an article by second edges 24, 36 due to reduced distortion of the tapes 14, 26.

The first and second stringers 4, 6 being separated by a greater distance in the second longitudinal portion than the first longitudinal portion is advantageous for reasons of improved engagement of the second slider 12 upon the intermediate body 8, and for reasons of reduced kinking, or puckering, of the tapes 14, 26 when the second slider 12 is at, or approaching, an uppermost or closed configuration (see FIG. 2 for a view of the slider fastener 2 with first and second sliders 10, 12 visible, and FIG. 3 for a view with θ indicated thereon).

Referring first to the resulting improved engagement, it will be appreciated from FIG. 2 that not all of the coupling elements of the second spaced set of coupling elements 18, 30 interdigitate with one another when the second slider 12 is in the closed configuration. That is to say, the uppermost coupling elements of the second spaced set of coupling elements 18, 30 are not interdigitated with one another. This is because upwards movement of the second slider 12 is limited by the presence of the intermediate body 8. Specifically, the upper end 48 of the second slider abuts the second end 46 of the intermediate body. Said abutment prevents further upward movement of the second slider 12. For the uppermost coupling elements of the second spaced set of coupling elements 18, 30 to be interdigitated with one another, the narrow portion 13 of the second slider 12 would have to pass over the uppermost coupling elements. Said passage cannot occur due to the second slider 12 abutting the intermediate body 8.

Because the uppermost coupling elements of the second spaced set of coupling elements 18, 30 are not interdigitated with one another, there exists a greater lateral separation between the uppermost coupling elements in comparison to the interdigitated coupling elements below the uppermost coupling elements. In order for the second slider 12 to be able to abut the intermediate body 8, the stringers 4, 6, specifically tapes 14, 26 thereof, should conform to the shape of the second slider 12. In other words, the tapes 14, 26, specifically the edges thereof, should be urged into a generally Y-shaped arrangement in the region below the intermediate body 8 (i.e. the region in proximity to the second slider 12). This also enables the edges of the tapes 14, 26 and the uppermost coupling elements to sit within the generally Y-shaped channel of the second slider 12 when the second slider 12 is in the fully closed configuration.

A problem with the aforesaid conformity is that the lateral offset between the stringers 4, 6 is a 'separated' lateral separation at the second end 46 of the intermediate body 8, whereas the lateral offset between the stringers 4, 6 at the first end 42 of the intermediate body 8 is an 'interdigitated' lateral separation. This is because in a lowermost position of the first slider 10, whereby the lower end 44 of the first slider 10 abuts the first end 42 of the intermediate body 8, the lowermost coupling elements of the first spaced set of coupling elements 16, 28 are interdigitated with one another. As such, the separation between the stringers 4, 6 is a first separation at the first end 42 of the intermediate body 8, and a second separation at the second end 46 of the intermediate body 8. The first separation corresponds to the lateral separation between the stringers 4, 6 when the respective coupling elements are interdigitated. The second separation is greater than the first separation and generally corresponds to the lateral separation between the stringers 4, 6 at the point they exit the upper portion 48 of the second slider 12.

This difference in lateral separation is facilitated by the stringers 4, 6 extending away from one another at an angle 2θ in a transition portion $L_4$ of the intermediate body 8 (see FIG. 3). The transition portion $L_4$ spans at least a portion of the longitudinal extent of the intermediate body 8. In some arrangements the transition portion $L_4$ may span the whole of a maximum longitudinal extent of the intermediate body 8.

The result of the different lateral separations between the stringers 4, 6 in the first and second longitudinal portions is that both first and second sliders 10, 12 can engage/contact respective first and second ends 42, 46 of the intermediate body 8.

It will be appreciated that the position of the stringers 4, 6 along the transition portion $L_4$ could be arranged in a number of ways other than the consistently diverging and equivalent angles of the illustrated embodiments. The stringers 4, 6 may otherwise diverge at a number of different angles, or diverge in an arcuate arrangement. Thus the invention disclosed herein in could be practised by ensuring that the distance between the cords of the respective stringers 4, 6, at a border between the first longitudinal portion $L_2$ and the transition portion $L_4$ is less than the distance between the cords of the respective stringers 4, 6 at a border between the second longitudinal portion $L_3$ and the transition portion $L_4$.

If the first and second stringers 4, 6 were not separated by the lateral distances as specified, the tapes 14, 26 may kink, or pucker, in the region near the second end 46 of the intermediate body 8 when the second slider 12 was in, or approached, a closed configuration. That is to say, the tapes 14, 26 would not be substantially flat, as is preferable in use and for attaching the slide fastener 2 to an article, and would instead have portions which, when viewed from the side, rise above and fall below the plane in which the tapes 14, 26 would otherwise lie. In other words, when viewed from the side, the tapes 24, 26 would resemble a clamshell, or rough waveform such as, for example, a generally sinusoidal appearance. The stringers 4, 6 extending away from each other (by an angle 2θ) may otherwise be referred to as diverging, or outwardly extending.

The kinking or puckering would be caused by the different lateral separation between the interdigitated and non-interdigitated coupling elements within the second slider 12, in combination with the tapes 14, 26 being generally held in place, or pinned, by the intermediate body 8 in the vicinity of the intermediate body 8. By having the stringers 4, 6 separated from one another by different lateral separations in the transition portion $L_4$, the stringers 4, 6 conform more closely to the geometry of the second slider 12. This is because the cords 22, 34 of the first and second stringers 4, 6 are substantially aligned with the non-interdigitated lateral separation of the uppermost coupling elements of the second spaced set of coupling elements 18, 30 at the second end 46 of the intermediate body 8. The fact that the stringers 4, 6, or portions thereof, diverge from one another allows the tapes 14, 26 to still be held in place by the intermediate body 8, but reduces the effects of kinking or puckering of the tapes 14, 26 in the vicinity of the upper portion 48 of the second slider 12 when the second slider 12 is in the fully closed configuration.

The angled offset 20 may allow for the cords 22, 34 of the first and second stringers 4, 6 to be substantially laterally aligned with both the lowermost coupling elements of the first set of coupling elements 16, 28 and the uppermost coupling elements of the second spaced set of coupling elements 18, 30. Said lateral offsets are different owing to the arrangement of the sliders 10, 12, whereby both sliders 10, 12 interdigitate respective coupling elements when moved in the same direction.

As will be appreciated from FIG. 3, the angle 2θ can be considered to be a vertex angle of an isosceles triangle. Sides of the triangle adjacent the angle 2θ are collinear with the cords 22, 34 in the transition portion $L_4$. A side of the triangle opposite the angle 2θ therefore lies within the intermediate body 8. Furthermore, the side of the triangle opposite the angle θ has a lateral extent which is less than a lateral extent of the second slider 12. In other words, the cords do not extend laterally outwardly of the second slider 12.

It will be appreciated that, whilst FIG. 3 indicates a value of θ, the first and second stringers 4, 6 extend away from one another by an angle 2θ. This is due to the fact that the first and second stringers 4, 6, specifically cords 22, 34 thereof, are substantially mirror images of one another about a plane of symmetry through the longitudinal axis $L_1$. As such, with each stringer 4, 6 extending away from the common longitudinal axis $L_1$ by an angle θ, the stringers 4, 6 are, in effect, extending away from one another by an angle 2θ.

Furthermore, it will be appreciated that, from the perspective shown in FIG. 3, the first and second stringers 4, 6 extend away from one another by an angle 2θ when moving in a direction from the first end 42 of the intermediate body 8 towards the second sets of coupling elements 18, 30. However, when moving in a direction from the second sets of coupling elements 18, 30 towards the first end 42 of the intermediate body 8, the first and second stringers 4, 6 may be said to extend toward one another at an angle 2θ.

2θ is greater than zero degrees. 2θ is preferably less than around 14 degrees. θ is preferably around 6°, and more preferably around 5.6°. The aforementioned definitions of θ refer to θ at longitudinal positions through the transition portion $L_4$ of the intermediate body 8.

FIG. 3 illustrates how a lowermost coupling element of the first set of coupling elements 16 of the first stringer 4 is partially hidden by the intermediate body 8. That is to say, a portion of the lowermost coupling element 16 of the first set of coupling elements 16 is partially embedded within the intermediate body 8. The partially embedded nature of the lowermost coupling element ensures that a lowermost coupling element of the first set of coupling elements 16 of the first stringer 4 does not separate from the corresponding coupling element of the first set of coupling elements 28 of the second stringer 6 when the first slider 10 is in a fully closed configuration. If the lowermost coupling element was not attached to the intermediate body 8, it may separate from the corresponding coupling element, despite the first slider 10 being in the fully closed configuration.

Figure 4:
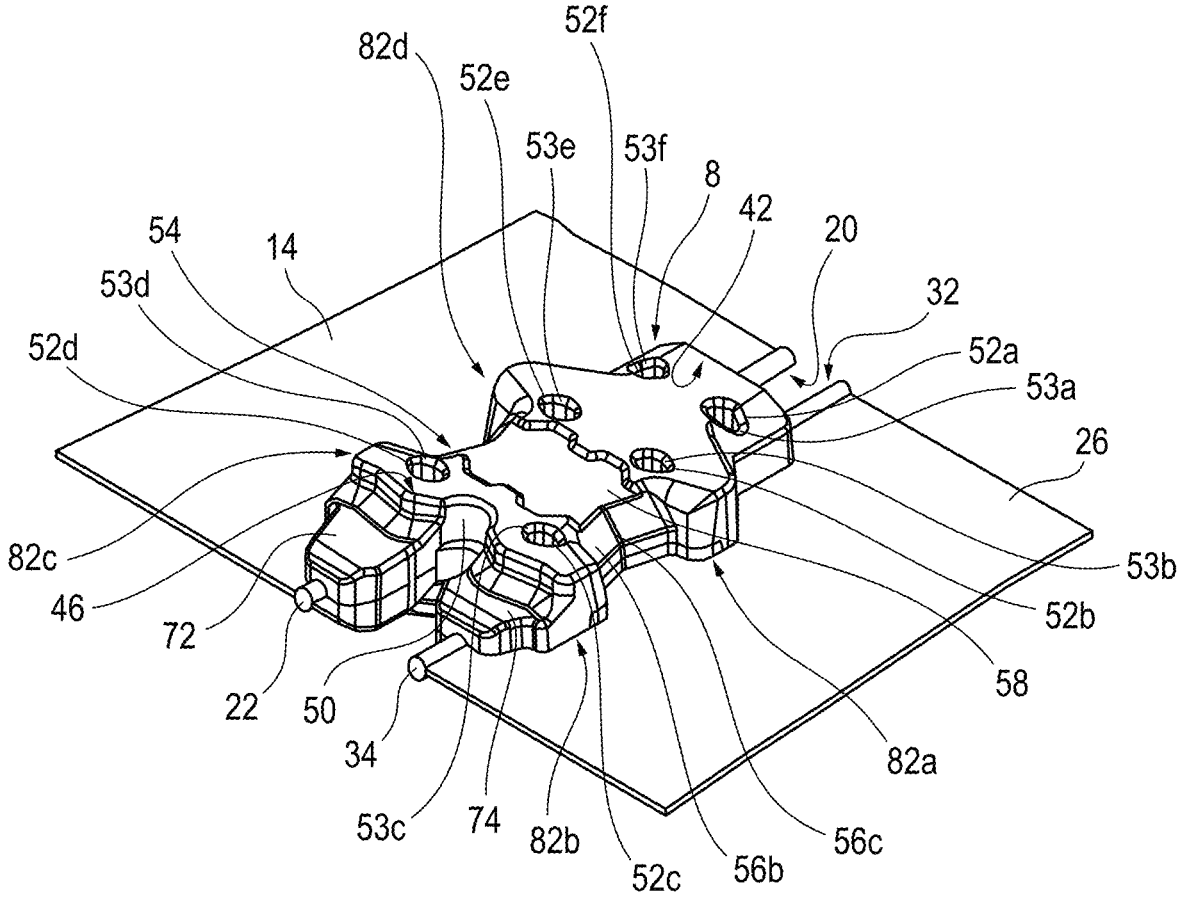
FIG. 4 shows a schematic perspective view of a portion of the slide fastener of FIG. 1, with coupling elements omitted.

Referring now to FIG. 4, FIG. 4 shows a perspective view of the intermediate body 8 as mounted to first and second tapes 14, 26. The cords 22, 34, which define the first edges 20, 32 of the first and second tapes 14, 26 respectively, are also shown. No coupling elements are illustrated in FIG. 4 in order to illustrate the intermediate body 8 and tapes 14, 26 in isolation. However, it will be appreciated that, in practice, the intermediate body 8 will typically be manufactured when coupling elements have already been attached to the first and second tapes 14, 26. As such, it is unlikely that, in practice, the intermediate body 8 will ever be attached to the tapes 14, 26 without any coupling elements already being attached thereto.

FIG. 4 shows the intermediate body 8 and many of the associated features which have been described above. In particular, a first end 42 of the intermediate body 8 is present, along with cavities 52*a-f*. Fillets 53*a-f* spanning an outermost surface of each of the cavities 52*a-f* are also visible. Shoulder portions 82*a-d* of the intermediate body 8, and their relative protrusion from the rest of the intermediate body 8, are illustrated. The laterally recessed portion 54 of the intermediate body 8 is shown, along with corresponding tapering surfaces 56*a*, 56*b* (tapering surface 56*a* not being visible in the FIG. 4 orientation). On the second tape 26 side (or second stringer side) of the laterally recessed portion 54, a parting line 56*c* is also visible. The parting line 56*c* interposes adjacent portions which form the tapering surface 56*b* on the second tape 26 side. Central portion 58 is also shown on the intermediate body 8, and the relative recess thereof is also shown in comparison to the rest of the intermediate body 8. The groove 50 in the second end 46 of the intermediate body 8 is also clearly illustrated in FIG. 4. Finally, first and second tabs 72, 74, and relative thicknesses (in a direction perpendicular to the plane of the slide fastener) thereof in comparison to the surrounding intermediate body 8, are also illustrated.

FIG. 5 is a side view of the intermediate body 8 mounted to the tape 26, and with first and second sliders 10, 12 attached thereto. Coupling elements, bridges of the sliders, and pullers, which attach to the bridges, are all omitted, and parts of the second slider 12 and intermediate body 8 are shown in a partial cross section view. The cross-section lines 77, 79 of FIG. 2 indicate from where the cross-section portions 81, 83 respectively are taken in FIG. 5.

FIG. 5 illustrates the second tape 26 running through the entirety of the first and second sliders 10, 12 and intermediate body 8 arrangement. Furthermore, and as was the case in FIG. 4, coupling elements of the first and second stringers are omitted.

A feature not previously described is that of a laterally extending groove 84 which is recessed into a rear face of the intermediate body 8. The laterally extending groove 84 provides an increase in flexibility of the intermediate body 8, which is beneficial for the reasons already described. The FIG. 5 view also shows the central portion 58 and its recess relative to the surrounding intermediate body 8 geometry. The first end of the intermediate body 42 and the lower portion 44 of the first slider 10 are also indicated in FIG. 5 for ease of reference.

FIG. 5 also more clearly indicates the functionality of the cavity 52*a* and its relative position through the intermediate body 8. As shown in FIG. 5, the cavity 52*a*, as seen from above, is an empty volume which is surrounded by material as indicated by the cross hatched surrounding geometry. The cavity 52*a*, and a corresponding opposing cavity 86*a*, are created by projections during the moulding process of the intermediate body 8. Projections, which correspond with the geometry of the cavities 52*a*, 86*a*, are used to pin the cord 32 of the second tape 26 in position when the intermediate body 8 is manufactured. As such, it will be observed that the cord 32 is disposed substantially equidistantly about a midpoint of a thickness of the intermediate body 8. That is to say, there is approximately as much of a thickness of material above the cord 32 in FIG. 5 as there is beneath the cord 32. As already discussed, the cord is visible through each of the cavities 52*a*, 86*a*.

In the FIG. 5 view, exposed portions of the tape 26 are also shown in the proximity of the cavities 52*a*, 86*a*. The exposed portions are visible due to the cavities 52*a*, 86*a*. Also visible in FIG. 5 is the diamond 70 of the second slider 12.

In a preferred embodiment, the slide fastener 2 is incorporated in an item of high performance sportswear or outdoor clothing. In a particularly advantageous arrangement, the slide fastener 2 spans from a sleeve of said garment, along the arm, and down the torso to a side of the torso in a region near the abdomen of the user. Due to the presence of the intermediate body 8, the two sliders 10, 12 provide the functionality that the coupling elements of the first and second spaced sets of coupling elements 16, 28, 18, 30 can be interdigitated and decoupled from one another independently. This provides the functionality that, for example, the first portion 38 can provide a ventilation function between the torso and the sleeve, whilst the second portion 40 provides a pocket-securing functionality. That is to say, the slide fastener 2 can advantageously provide two separate fastening functionalities which can be used independently of one another. This is just one specific example of how the two independent sliders can provide an advantageous use in a garment.

It will be appreciated that the longitudinal extents of the first and second portions 38, 40 do not need to be equal, or even nearly equal, and can be modified to suit the specific purpose of the slide fastener 2. For example, it may be preferable to have a comparatively longer first portion 38 if that is to provide a venting functionality, whilst it may be preferable to have a comparatively shorter second portion 40 if that is to provide a pocket-securing functionality. Pocket-securing functionality is intended to mean that opening or closing a portion of the slide fastener 2 opens or closes a pocket.

Figure 6:
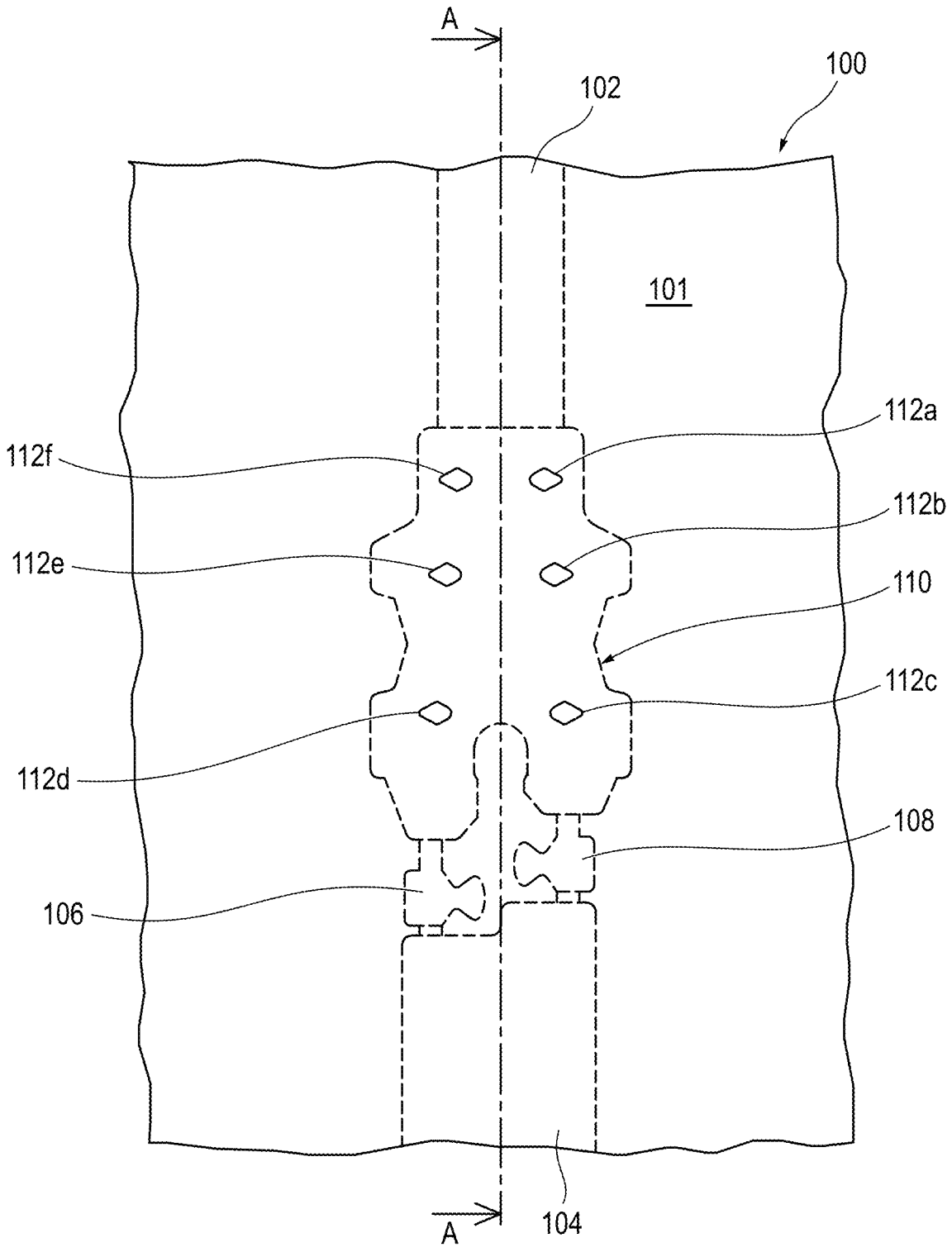
FIG. 6 is a schematic view of an upper die, used to manufacture the slide fastener of FIG. 1, from above.

Moving on to discuss a method of manufacture of the slide fastener 2 of the preceding figures, specifically the intermediate body 8 thereof, FIG. 6 is a view of an upper die 100 used to make the intermediate body 8, from above. Although not shown in FIG. 6, in use, a corresponding lower die 200 (see FIG. 7) abuts a lower side 101 of the upper die 100, surrounding stringers 300 to which the intermediate body is to be attached. The FIGS. schematically indicate a cavity for the intermediate body 8 and respective channels 102, 104 into which coupled elements can be channelled through the combination of the upper die 100 and lower die 200.

It will be appreciated that the terms upper and lower, when used to specify the dies only, refer to the vertical position of the dies when viewed from the side. This is in contrast to the use of the terms upper and lower when used to describe the slide fastener 2, optionally in the context of the dies, which generally refer to the vertical position when viewed from above and below.

It will be clear, in view of FIG. 3, how the recessed geometry of the upper die 100, indicated by dashed lines, corresponds to the geometry of the slide fastener 2. Specifically, the upper die 100 incorporates two recessed channels 102, 104. It is in the recessed channels 102, 104 that the first and second stringers are received. The first and second stringers comprise respective tapes with coupling elements attached thereto. Adjacent a first end of the lower recessed channel 104, two coupling element recesses 106, 108 are also recessed into the upper die 100. The coupling element recesses 106, 108 each correspond to a typical geometry of coupling element. That is to say, each incorporate a base portion which attaches to a cord, a head portion which interlocks with an opposing coupling element, and a neck portion disposed therebetween. These recesses help to correctly position the stringers to receive a molten material which will form the intermediate body.

A recessed cavity 110, which corresponds with the geometry of the intermediate body 8, is also shown in FIG. 6. The various features of the intermediate body 8 are indicated and will not be discussed in more detail, given that they have been described above in connection with FIGS. 1-5. Of note in FIG. 6 are projections 112*a-f*, which correspond with cavities 52*a-f*, and which project through the recessed cavity 110. The projections 112*a-f* project to an extent which terminates in the region of, but not quite at, a parting line between the upper and lower dies. The parting line is a line at which the upper die 100 meets the lower die 200 to thereby form a mould cavity during the manufacture of the intermediate body 8. The parting line substantially corresponds with a plane collinear with a lower surface 101 of the upper die 100, and an upper surface 201 of the lower die 200.

Figure 7:
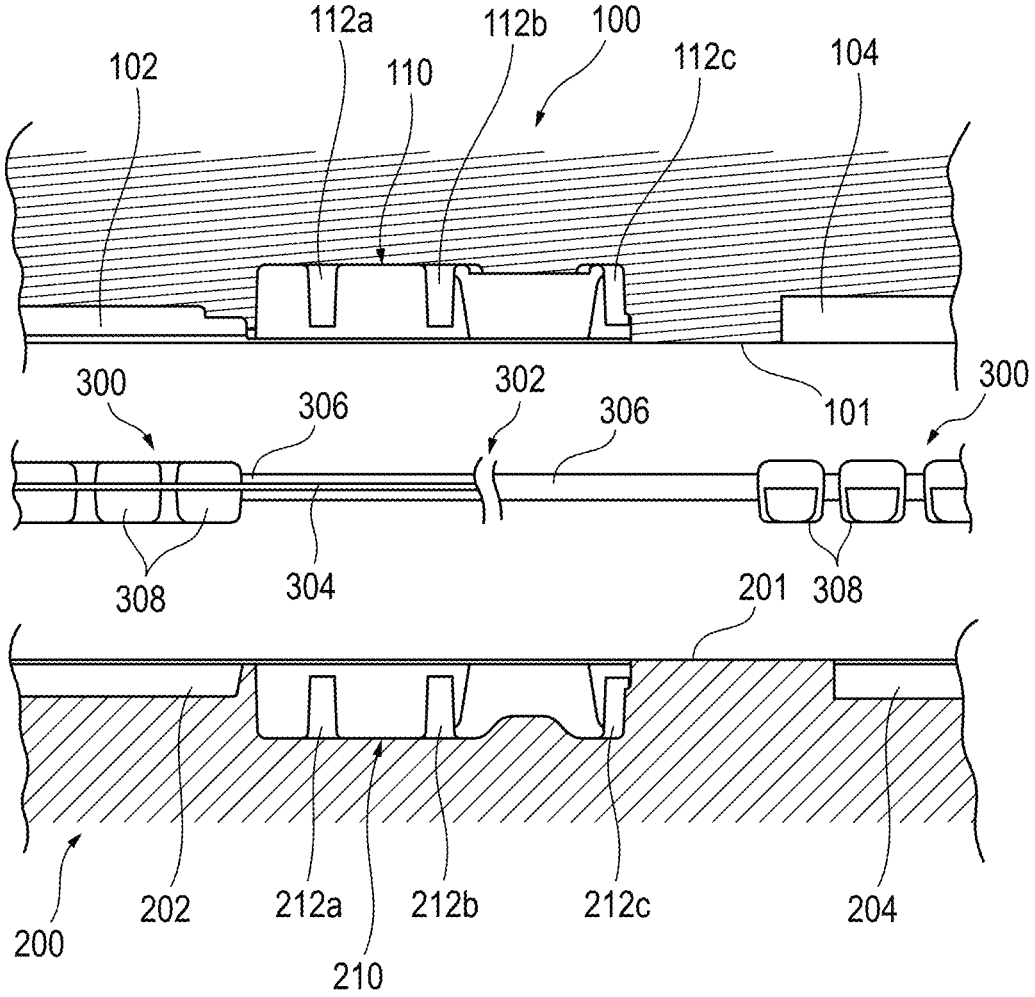
FIG. 7 is a cross-sectional schematic side view of an arrangement of lower and upper dies below and above a partial cross sectional view of stringers used to manufacture the slide fastener, particularly the intermediate body thereof, of FIG. 1.

FIG. 7 is an exploded side view of a cross section taken about line A-A of FIG. 6 at a point in time preceding the manufacture (e.g. moulding) of the intermediate body 8.

Shown in FIG. 7 are the lower die 200 and the opposing upper die 100, as described in detail in connection with FIG. 6. As shown in FIG. 7, first and second stringers 300 are located between lower and upper dies 200, 100.

The stringers 300 are displayed in two different forms about a dividing line 302. To the left hand side of dividing line 302, the stringers 300 are shown in a side view. In other words, to the left hand side of dividing line 302 a side view of the slide fastener is shown where the coupling elements are coupled together. As such, a tape 304, having a cord 306 at one edge is visible in the region of the slide fastener which approaches line 302. Attached to the cord 306 are a first set of coupling elements 308 (only some of which are visible in FIG. 7). For the stringer 300 as shown on the right hand side of the dividing line 302, in the region extending from the line, only the cord 306 is visible, and not the tape 304. This is due to the fact that the right hand side of the dividing line 302 is a view of the first stringer, owing to this section being a side view visible from the line A-A of FIG. 6. Coupling elements 308 are also shown on the right hand side of the dividing line 302.

Because at least some of the coupling elements of the first set of coupling elements 308 on the left hand side of the dividing line 302 are coupled, or interdigitated, with one another, the stringers 300 may otherwise be referred to as a fastener chain. This is because pairs of stringers may otherwise be referred to as a fastener chain when constituent coupling elements are interdigitated with one another.

The lower die 200 comprises many features which correspond with those of the upper die 100. Namely, the lower die 200 also comprises recessed channels 202, 204, recessed cavity 210 and projections 212*a-c*. It therefore follows that the lower die 200 comprises many features which correspond with those of the upper die 100.

A method of manufacture of the slide fastener 2 of the previous figures will now be described.

Initially, the lower and upper dies 200, 100 are, if not already separated, separated to provide access to the recessed cavity 210 of the lower die 200. In many instances, this may involve raising the upper die 100, if required. With the features of the lower die 200 exposed, the first and second stringers must first be aligned correctly relative to the lower die 200. Reference numerals from the first and second stringers of the previous figures (i.e. FIG. 1 to FIG. 5) will not be used because, in these stringers, the intermediate body 8 has already been manufactured. Based upon the numbering of FIG. 7, first and second stringers 300 are therefore aligned with corresponding recesses in the lower die 200. Considering FIG. 7, this would involve taking a first of the first and second stringers 300, and placing the tape 304 into the recessed channels 202, 204. An uppermost coupling element of the second set of coupling elements of the first and second stringers 300 will be received in the coupling element recesses which correspond with the coupling element recesses 206, 208 of the upper die 100 in FIG. 6. Furthermore, in the region of the recessed cavity 210, the respective tapes will be supported by the projections 212*a-f* (only 212*a-c* being visible in FIG. 7). As explained above, the length of the intermediate body once manufactured means that a relative distortion of the tape, owing to a reduced skew angle between the cords 306, will be reduced in comparison to a shorter intermediate body. With the tapes 304 of the stringers 300 correctly aligned relative to the lower die 200, a midpoint of a thickness of the tape 304 should substantially align with the upper surface 201 of the lower die 200.

With the stringers 300 in position in the lower die 200, the lower and upper dies 200, 100 are brought into abutment with one another. This will typically involve the upper die 100 being lowered. The upper die 100 is lowered until a lower surface 101 of the upper die 100 abuts an upper surface 201 of the lower die 200. At this point, the lower and upper dies 200, 100 are in abutment, and respective recessed cavities 210, 110 define a single mould cavity. It is the mould cavity which is a negative of the intermediate body, and which will be filled with molten material to form the intermediate body. The recessed cavity 110 of the upper die 100 may be referred to as an upper cavity of the upper die 100. Similarly, the recessed cavity 210 of the lower die 200 may be referred to as a lower cavity of the lower die 200.

At the point whereby the upper die 100 is brought into abutment with the lower die 200, projections 112*a-c* of the upper die 100 abut and then pinch the cords 306 of the tapes 304 of the stringers 300. In other words, the cords 306 are pinned in place by the projections 112*a-c*. Similarly, coupling elements of the stringers 300 are received by the recessed channels 102, 104 of the upper die 100. As mentioned above, with the upper and lower dies 100, 200 in abutment, a mould cavity is thereby defined. Furthermore, the stringers 300 are, in the region of the tapes 304, specifically the cords 306 thereof, are supported and/or pinned in place by the projections 212*a-c* and 112*a-c* of the lower and upper dies 200, 100 respectively. Specifically, the cords 306 are supported/pinned in place by distal ends of the projections 112*a-c*, 212*a-c*. Furthermore, the illustrated projections 112*a-c*, 212*a-c* are pins. However, alternative geometries are suitable.

Figure 8:
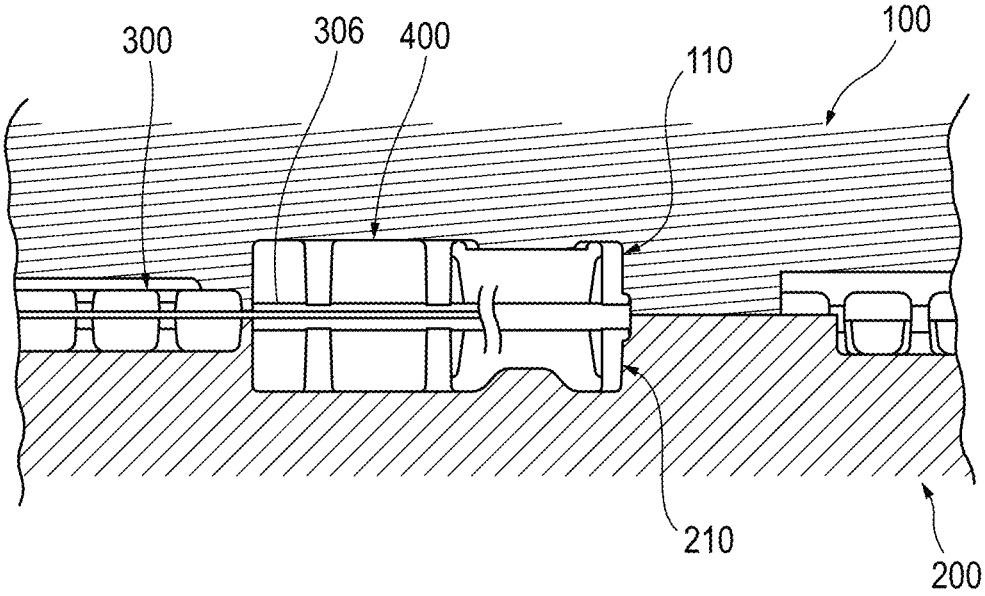
FIG. 8 is a cross-sectional schematic side view of lower and upper dies enclosing the stringers during the manufacture of the slide fastener of FIG. 1.

FIG. 8 shows the upper die 100 in abutment with the lower die 200. Also shown is the mould cavity 400 which is defined by both the recessed cavities 110, 210 of the upper and lower dies 100, 200 respectively. It will be observed that the projections 112*a-c* and 212*a-c* of the upper and lower dies 100, 200 respectively pinch the cord 306 of the stringer 300 and thereby hold the stringer 300 in position.

At this point, the mould cavity 400 is filled with molten material. This is preferably synthetic resin. The synthetic resin is preferably made from a material which is softer, or more flexible, than the material from which the coupling elements are manufactured. Examples of synthetic resins include polyurethane, rubber or silicone rubber, or another elastomer. The material used to manufacture the coupling elements may also be a synthetic resin, but preferably this material has a lower Young's Modulus than the material from which the intermediate body is made. Examples of materials from which the coupling elements may be manufactured include POM, PBT, Nylon or any other material known to a person skilled in the art.

Figure 9:
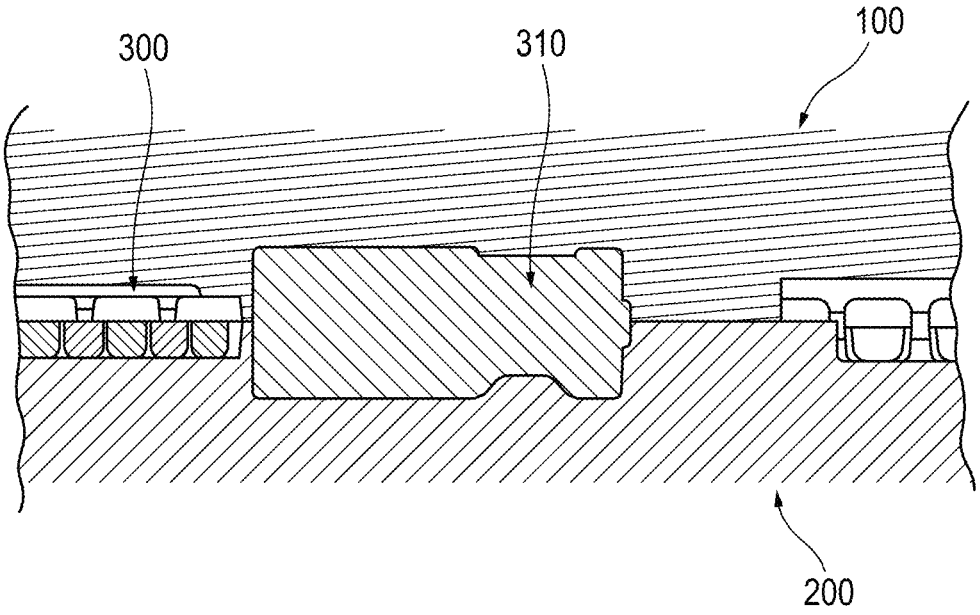
FIG. 9 is a cross-sectional schematic side view of a portion of the slide fastener of FIG. 1 after injection moulding of the intermediate body has occurred.

The molten material fills the mould cavity 400, as is typical in an injection moulding process. Once the molten material cools, an intermediate body is formed. Due to the presence of the projections 212*a-c* and 112*a-c*, the molten material does not fill the entire mould cavity 400 in a solid mass. Instead, the molten material fills the mould cavity 400 everywhere other than in the regions obscured by the projections 212*a-c*, 112*a-c*. As such, these cavities remain present in the intermediate body, as described in connection with earlier figures. At the point whereby the molten material is injected, and has cooled, an intermediate body 310 is formed, as shown in FIG. 9. It is noted that the intermediate body 310 of FIG. 9 appears to be completely solidly filled material. However as mentioned above, the cavities will exist through the intermediate body.

Also during injection of the molten material, mounting projections are formed as part of the intermediate body 310. That is to say, and as has been explained above, apertures in the tapes 304 are filled with molten material which, upon cooling, forms the mounting projections. Said mounting projections more securely attach the intermediate body 310 to the tapes 304, increasing the robustness of the slide fastener.

The dies 100, 200 can then be moved away from one another, the intermediate body 310 having been formed.

With the intermediate body 310 formed, the first and second sliders can be added and the slide fastener is thereby manufactured. The slide fastener can then be attached to articles, such as garments, by way of sewing, adhesive means or any other appropriate means.

Although referred to as an intermediate body, the intermediate body does not need to be disposed about a midpoint of a longitudinal extent of the stringers. That is to say, all that is required is that there are coupling elements either side of the intermediate body.

Within this document the term maximum longitudinal extent may otherwise be referred to as an overall length.

A longitudinal direction is taken to be a direction of travel of the sliders along the slide fastener in use.

Within the present document lengths referred to and the use of the term long is intended to relate to such concepts in the longitudinal direction.

Lateral is taken to be a direction substantially perpendicular to the longitudinal axis.

The lower and upper dies being in abutment with one another may be referred to as a closed state of the dies. The lower and upper dies not being in abutment with one another may be referred to as being in an open state of the dies.

The coupling elements, tapes, intermediate body, sliders and, where appropriate, top and/or bottom stops may be formed from any appropriate material.

The pitch length of the coupling elements may be any appropriate length.

Within the above description the first and second stringers are each said to include a spaced set of coupling elements. These coupling elements are described as separate coupling elements or teeth of a particular shape/type. It will be appreciated that the invention is equally applicable to any particular shape or type of coupling elements. In addition, the invention equally applies when the first and second stringers each include spaced sets of coupling elements in the form of turns of a coil. That is to say, the term coupling element within the claims covers both a tooth and a turn of a coil. The spaced sets of coupling elements of the first and second stringers may take any appropriate form, provided the discussed movement of the slider can cause the discussed releasable interdigitation of the coupling elements. A plurality of elements may be a plurality of teeth or may be a length of coil with a plurality of turns.

The described and illustrated embodiments are to be considered as illustrative and not restrictive in character, it being understood that only preferred embodiments have been shown and described and that all changes and modifications that come within the scope of the inventions as defined in the claims are desired to be protected. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

Optional and/or preferred features as set out herein may be used either individually or in combination with each other where appropriate and particularly in the combinations as set out in the accompanying claims. Similarly, optional and/or preferred features set out in combination with the various aspects of the invention are equally applicable to other aspects of the invention.

According to a first aspect of the invention there is provided a slide fastener including:

first and second stringers, each of the first and second stringers including a tape and first and second spaced sets of coupling elements disposed along two spaced portions of an edge of the tape, each set of coupling elements having a pitch spacing;

an intermediate body fixedly attached to both the first stringer and the second stringer, the intermediate body interposing the two portions of each edge of the tapes of the first and second stringers;

a first slider being traversable along a longitudinal axis along a first of said two spaced portions of each of the edges of the tapes, movement of the first slider in a first direction being configured to cause the coupling elements disposed along the first portion of each of the edges of the tapes to interdigitate with one another;

a second slider being traversable along the longitudinal axis along a second of said two spaced portions of each of the edges of the tapes, movement of the second slider in the first direction being configured to cause the coupling elements disposed along the second portion of each of the edges of the tapes to interdigitate with one another; and wherein the first and second stringers are separated by a first lateral distance in a first longitudinal portion, the first and second stringers are separated by a second lateral distance in a second longitudinal portion, and a transition portion extending along at least a portion of a longitudinal extent of the intermediate body interposes the first and second longitudinal portions, and the second lateral distance is greater than the first lateral distance.

In other words, the lateral distance between the first and second stringers in the first and second longitudinal portions are different.

Lateral distance may otherwise be referred to as an offset, or separation.

Specifically, it may be the edges of the tapes of the first and second stringers which are separated by the aforementioned distances. Cords may define the edges of the tapes.

The transition portion may extend along all of the longitudinal extent of the intermediate body. The first longitudinal portion may extend along at least a portion of the longitudinal extent of the intermediate body. The second longitudinal portion may extend along at least a portion of the intermediate body. The transition portion may span an entire longitudinal extent between the first and second longitudinal portions. Alternatively, the transition portion may only span a portion of an entire longitudinal extent between the first and second longitudinal portions. That is to say, the transition portion may only occupy a portion of a longitudinal extent between the first and second longitudinal portions. It will be appreciated that the above references to the features of the transition portion and the longitudinal extent of the intermediate body may be swapped with one another. That is to say, in one specific example, where the transition portion extends along all of the longitudinal extent of the intermediate body, this could otherwise be described as all of the longitudinal extent of the intermediate body extending along the transition portion.

Preferably the first and second sliders are substantially identical. Preferably a pitch spacing of the coupling elements of the first and second sets of spaced coupling elements is substantially identical.

The slide fastener may be fluid resistant. The slide fastener may be waterproof.

An advantage of the different separation between the stringers in the first and second longitudinal portions, as specified above, is that the second slider can more closely engage the intermediate body when the second slider is in a fully closed configuration. This is due to the fact that, because both sliders cause respective coupling elements to interdigitate with one another when moved in the first direction, the second set of coupling elements are, at one end of the second slider, interdigitated with one another whilst at the other, intermediate body end of the second slider, at least partially separated from one another. It will be understood that there exists a lateral separation between the coupled and separated coupling elements and therefore a lateral separation exists between the ends of the second slider. As such, for the second slider not to be prevented from moving towards the intermediate body due to this difference in lateral separation, the coupling elements are disposed so as to at least partially conform to the geometry of the second slider (i.e. be generally Y-shaped). For this to occur, the coupling elements, and therefore the stringers to which they are attached, are laterally offset from one another by a greater extent in the vicinity of the intermediate body in the region near the second set of coupling elements than in the region near the first set of coupling elements. Because the opposing end of the intermediate body (i.e. the region near the first set of coupling elements) defines a lowermost point of travel of the first slider (which traverses the first set of coupling elements), there exists a lateral offset between the stringers in the vicinity of each end of the intermediate body, and through a transition portion thereof. Having the different lateral separations between the first and second stringers in the first and second longitudinal portions therefore means that the second slider can more closely engage the intermediate body, thereby providing an improved seal.

Furthermore, the different separations between the first and second stringers in the first and second longitudinal portions means that when the second slider is in an uppermost, or closed, configuration, the tapes of the stringers are more flat and any kink or puckering of the tapes is reduced. Kinking or puckering of the tapes is intended to refer to the tapes being forced towards or away from a longitudinal axis which, given the tapes are fixed in certain positions, including by the intermediate body, leads to portions of the tapes rising or sinking out of a plane in which the tapes would otherwise lie. In such instances, a side-on view of the tapes may resemble that of a clam shell, or a roughly sinusoidal waveform. Kinking or puckering of the tapes is undesirable because, in order to be affixed to an article, the tapes should remain substantially flat. Furthermore, attachment of the slide fastener to an article is made considerably more difficult if the tapes are kinked or puckered, with the tapes needing to be substantially flat to be attached.

The first and second stringers may diverge in a lateral direction in the transition portion.

The first and second stringers may diverge at an angle. The angle may be equal to $2\theta$. $2\theta$ is greater than $0°$. $2\theta$ is preferably less than around $14°$. Put another way, $\theta$ is greater than $0°$, and $\theta$ is preferably less than around $7°$.

The divergence may be at a constant angle throughout the transition portion. Alternatively, the divergence may not be at a constant angle and may instead be, for example, arcuate or some other non-linear path.

The stringers extending away from one another, or diverging, may more specifically be described as the edges of the tapes thereof extending away from one another, or diverging. The edges may include cords.

The transition portion may therefore be a longitudinal portion in which the first and second stringers diverge in a lateral direction. Alternatively, the transition portion may include a portion in which the first and second stringers diverge in the lateral direction. That is to say, the first and second stringers may diverge in all, or a portion of, the transition portion.

A maximum longitudinal extent of the intermediate body may be greater than or equal to a distance equal to five pitch spacings.

A pitch is equal to a maximum longitudinal extent of a coupling element, in combination with a maximum longitudinal extent of a gap between two adjacent coupling elements.

Five pitch spacings may be equal to between around 15 mm and around 17 mm.

It will be appreciated that a maximum longitudinal extent of the intermediate body, or a part thereof, may be defined by a lowermost end of a tab of the intermediate body.

A benefit of the minimum length specified is that of flexibility of the intermediate body. The intermediate body being more flexible is beneficial for reducing leakage of fluid between the first and second sliders, and the intermediate body, when the first and second sliders are in fully closed positions. The improved flexibility is also beneficial for being able to more easily manipulate the first and second sliders. That is to say, the first and second sliders are less likely to become stuck, or jam, when being translated about the longitudinal axis in proximity to the intermediate body.

An advantage of the intermediate body being at least five pitch lengths long is that cords of the tapes between the first and second portions are less skewed during manufacture. In other words, the cords between the first and second spaced sets of coupling elements are closer to being parallel with the longitudinal axis than would be the case if the intermediate body was shorter. This means that manufacturing the slide fastener is simpler, owing to the fact that the tapes are more likely to distort if the cords are more skewed. The incorporation of the slide fastener in an article is also made simpler as a result. For example, if the slide fastener were to be incorporated by sewing the tapes to fabric pieces, a worker would have to press down on the tapes to flatten them out (due to kinking of the tapes of the slide fastener) before sewing them to the fabric pieces. As a result of the minimum length of the intermediate body specified above, less manipulation of the tapes is required during manufacture of the intermediate body, and subsequent attachment of the slide fastener to an article.

Furthermore, with increased skew of the tapes relative to one another, more force is required to hold the tapes in place. This is due to a more pronounced 'spring back' effect whereby the tapes, when more skewed, require more of a holding force to prevent them from returning to their 'at rest', or original, position. This means that setting the tapes on the die during manufacture requires less force, and is therefore simpler. This also applies to the force required to hold the tapes in position once the slide fastener has been manufactured, when the slide fastener is subsequently attached to an article. Ultimately, reduced skew means that manufacture is easier.

A further advantage of the intermediate body being at least five pitch lengths long is that it facilitates the first and second stringers extending away from one another at an angle $2\theta$ in the transition portion.

The intermediate body may include at least one cavity, said at least one cavity exposing a cord of at least one of the tapes.

The cavities are formed by projections during the manufacture of the intermediate body. The projections press against the cords of the tapes so as to correctly position the tapes of the stringers relative to one another. With the cords correctly positioned, the intermediate body can be formed around the cords by a process such as injection moulding. Upon removal of the die, of which the projections form part, the cavities remain in the intermediate body.

The intermediate body may include a plurality of cavities, said cavities exposing cords of the tapes of both the first stringer and the second stringer.

Of the plurality of cavities, at least two cavities may expose the cords of the tape of the first stringer. Similarly, at least two cavities may expose the cords of the tape of the second stringer.

A higher number of cavities is advantageous in providing more points at which the tapes are pinned in place during manufacture of the slide fastener. In other words, the incorporation of more cavities is likely to result in a more accurately positioned intermediate body.

The intermediate body may include at least two mounting projections, at least one mounting projection being received by a corresponding aperture of the tape of the first stringer, and at least one mounting projecting being received by a corresponding aperture of the tape of the second stringer.

The mounting projections are advantageous in that they more securely attach the intermediate body to the respective tape. Furthermore, the mounting projection and corresponding aperture are easily manufactured features.

The intermediate body may include a laterally recessed portion.

The laterally recessed portion increases the flexibility of the intermediate body, owing to the reduced amount of material present. The improved flexibility is beneficial for reasons of easier manipulation of the slide fastener, specifically the sliders thereof, and improved sealing of the sliders against the intermediate body.

The laterally recessed portion may incorporate one or more tapered surfaces. Said one or more tapered surfaces may constitute outermost sides of the laterally recessed portion.

The laterally recessed portion may otherwise be referred to as a concave portion, or a neck portion.

The laterally recessed portion may incorporate a laterally extending groove.

The laterally extending groove increases the flexibility of the intermediate body. The groove may be V-shaped or, in other words, be generally triangular in cross-section when viewed normal to the lateral direction (or perpendicular to the plane of the slide fastener). The groove may be in a rear face of the intermediate body, and, may form part of the laterally recessed portion.

At least two of the mounting projections may be at least partially disposed in shoulder portions of the intermediate body.

The mounting projections being disposed in the shoulder portions is beneficial because the shoulder portions provide extra material to which the mounting projections can be attached. This reduces the risk of the mounting projections becoming detached from the intermediate body.

The intermediate body may include a first end configured to abut a lower portion of the first slider, and the intermediate body may include a second end configured to abut an upper portion of the second slider.

The abutments defined above are beneficial because they remove the need for a top stop for one slider and a bottom stop for the other slider. Instead, the travel of each slider in one direction is limited by the presence of the intermediate body.

The lower/bottom portion of a slider may be referred to as a rear of the slider. The upper/top portion of a slider may be said to include shoulders of the slider.

A lateral extent of the lower portion of the first slider may be substantially equal to a lateral extent of the first end of the intermediate body. A lateral extent of the upper portion of the second slider may be substantially equal to a lateral extent of the second end of the intermediate body. This may be desirable for reasons of improved aesthetics.

The second end of the intermediate body may include a groove in which at least part of a diamond of the second slider is receivable.

By being able to receive at least part of the diamond, the groove allows the second slider to more closely abut the intermediate body. This improves the seal which is formed between the intermediate body and the second slider, which thereby improves the sealing capability of the slide fastener. In other words, the groove allows the second slider to be more closely received by the intermediate body.

First and second tabs may extend in a longitudinal direction from the second end of the intermediate body, and the first and second tabs may be configured to engage flanges and/or a diamond which define corresponding openings in the second slider.

The first and second tabs may otherwise be referred to as projections or protrusions.

The engagement of the first and second tabs with flanges and/or the diamond which define openings in the second slider (i.e. the first and second tabs being received by corresponding openings in the second slider) also improves the effectiveness of the seal between the second slider and the intermediate body. The various bodies create a labyrinth seal of sorts, making the path through which fluid must flow, to pass through the slide fastener, more tortuous.

Optionally, the first tab has a greater longitudinal extent than the second tab.

The difference in longitudinal extents, or lengths, of the first and second tabs compensates for the relative positions of the closest coupling elements thereto. Specifically, the coupling element longitudinally adjacent the first tab is positioned at a longitudinally lower position than the coupling element longitudinally adjacent the second tab. The lengths of the respective tabs compensate for this, the first tab engaging the second slider to a greater extent to reduce the gap and improve the strength of the interdigitation thereof. In other words, the tabs are sized so as to even out an otherwise uneven gap which would otherwise exist along the respective tapes, between an uppermost coupling element and the intermediate body.

The first and second tabs may have a reduced thickness relative to the rest of the intermediate body, the reduced thickness preferably being substantially equal to a thickness of the coupling elements of the second spaced set of coupling elements.

The intermediate body may be manufactured from a material which has a lower Young's modulus value than that of a material from which the coupling elements are manufactured.

The Young's modulus is a material constant indicative of the flexibility of the material. The relative Young's Modulus values of the materials from which the intermediate body and coupling elements are manufactured is useful for reasons of reduced leakage of fluid in the vicinity of the intermediate body. The lower Young's Modulus, and so more flexible, material from which the intermediate body is manufactured is able to form an improved seal with a slider which passes over the coupling elements. Similarly, the lower Young's Modulus of the material from which the intermediate body is also beneficial in enabling the user to more easily manipulate the slide fastener about the intermediate body.

Examples of materials from which the intermediate body may be manufactured include polyurethane, elastomers, rubber gum and silicone rubber. Examples of materials from which 20 the coupling elements may be manufactured include POM, PBT and Nylon.

The slide fastener may include two or more intermediate bodies.

The intermediate bodies may be substantially identical to one another.

According to a second aspect of the invention there is provided an article including a slide fastener according to a first aspect of the invention.

Preferably the article is a garment, such as high performance sportswear or outdoor clothing.

According to a third aspect of the invention there is provided a method of manufacturing a slide fastener, the method including the steps of:

a) positioning, on a lower die, tapes of first and second stringers relative to one another such that a separation between cords disposed at edges of the first and second stringers is a first distance in a first longitudinal portion, a second distance, greater than the first distance, in a second longitudinal portion, and varies with longitudinal position in a transition portion disposed between the first and second longitudinal portions;

b) bringing an upper die into abutment with the lower die, the upper die and lower die thereby defining a mould cavity, at least one of the upper die and the lower die including one or more projections which project into and thereby define a part of the mould cavity, distal ends of the one or more projections abutting and pinching at least the cords of the first and second stringers to thereby secure the cords in position;

c) injecting a molten material into the mould cavity, the material thereby filling the mould cavity other than a portion of the mould cavity obscured by the one or more projections, to define an intermediate body at the transition portion;

d) the molten material cooling to form the intermediate body; and e) removing the upper and/or lower die such that the intermediate body includes cavities where the one or more projections were disposed.

Manufacturing using the above method allows the cords of the tapes to be held in place whilst the intermediate body is formed by injection moulding. The projections ensure the tapes are correctly held in position, and do not distort owing to the different separations between cords of the tapes. Distal ends of the one or more projections may otherwise be described as outer ends, outermost ends, exposed ends, or cord-contacting ends of the one or more projections.

Separation may otherwise be referred to as a lateral offset between the cords. In other words, the separation is the distance between the cords in a direction substantially perpendicular to the longitudinal axis.

The separation between the cords may vary linearly, in an arcuate or other non-linear manner, or a combination thereof, with longitudinal position in the transition portion.

Mould cavity is intended to refer to an overall cavity which is defined by the combination of the upper and, optionally, lower cavities defined by each of the upper and lower dies respectively. That is to say, each of the upper and lower dies define a cavity with one open face, and when the upper and lower dies are brought together, said cavities define a mould cavity. It is the mould cavity into which molten material is injected, the mould cavity therefore being a 'negative' of the intermediate body.

The material may be synthetic resin.

The first and second stringers may diverge in a lateral direction in the transition portion.

The divergence may be at a constant angle throughout the transition portion. Alternatively, the divergence may not be at a constant angle and may instead be, for example, arcuate or some other non-linear path.

A maximum longitudinal extent of the intermediate body may be equal to at least to five pitch spacings of coupling elements of the first and second stringers.

The one or more projections may be pins.

Pins are an advantageous shape because their cross-sectional area is relatively small. This is desirable because the volume of the projection is equivalent to the volume of material which will not be injection moulded as part of the forming of the intermediate body. Said volume reduction may have the effect of reducing the strength of the intermediate body, and so it is desirable to reduce the volume where possible. Using pins as the one or more projections is one way of achieving a smaller cross-sectional area, and so smaller volume of cavity.

The lower die may include a lower cavity and the upper die may include an upper cavity, and the one or more projections may align the tapes of the first and second stringers such that the tapes are disposed substantially equidistantly from outermost points of each of the upper and lower cavities defined by the upper die and the lower die respectively.

Outermost point is intended to mean a point of the cavities which, during manufacture, is disposed at a greatest distance from the tapes. That is to say, for the lower cavity of the lower die, the outermost point of the lower cavity is a lowermost point within the lower cavity. For the upper cavity of the upper die, the outermost point of the upper cavity is an uppermost point within the upper cavity.

The tapes may be substantially aligned with a parting line between the upper and the lower die.

The one or more projections may align the tapes as specified above by virtue of distal ends of the one or more projections abutting the tapes.

Upon injection of the molten material, the molten material may pass through, and thereby fill, apertures disposed in the tapes of the first and second stringers, said material, upon cooling, thereby forming mounting projections which penetrate corresponding apertures in the tapes to secure the intermediate body thereto.

Said positioning of the tapes of first and second stringers on the lower die may include the steps of:

i) aligning innermost coupling elements of each of the first and second stringers with a corresponding recess in the lower die; and ii) urging the first and second stringers into the lower die such that the innermost coupling elements are received by the corresponding recesses 'Innermost coupling elements' is intended to refer to the coupling elements of each of the first and second stringers which are in closest proximity to the intermediate body (when formed). That is to say, when the stringers are placed into the lower die, before the intermediate body is formed, the innermost coupling elements of the first stringer are the coupling elements which bound a region of the tape with no coupling elements disposed thereon. Said coupling element-free region is where the intermediate body is formed. This also applies to the second stringer.

Innermost coupling elements form the group of elements including a lowermost coupling element of a first set of coupling elements, and an uppermost coupling element of a second set of coupling elements and thus a reference to a singular innermost coupling element may, in context, refer to either.

According to a fourth aspect of the invention there is provided a slide fastener including:

first and second stringers, each of the first and second stringers including a tape and first and second spaced sets of coupling elements disposed along two spaced portions of an edge of the tape, each set of coupling elements having a pitch spacing;

an intermediate body fixedly attached to both the first stringer and the second stringer, the intermediate body interposing the two portions of each edge of the tapes of the first and second stringers;

a first slider being traversable along a longitudinal axis along a first of said two spaced portions of each of the edges of the tapes, movement of the first slider in a first direction being configured to cause the coupling elements disposed along the first portion of each of the edges of the tapes to interdigitate with one another;

a second slider being traversable along the longitudinal axis along a second of said two spaced portions of each of the edges of the tapes, movement of the second slider in the first direction being configured to cause the coupling elements disposed along the second portion of each of the edges of the tapes to interdigitate with one another; and wherein a maximum longitudinal extent of the intermediate body is greater than or equal to a distance equal to five pitch spacings.

It will be appreciated that, where appropriate, any of the optional features discussed in relation to one aspect of the invention above, may be applied to any other aspect of the invention discussed above.

What is claimed is:

1. A slide fastener comprising:

first and second stringers, each of the first and second stringers comprising a tape and first and second spaced sets of coupling elements disposed along two spaced portions of an edge of the tape, each set of coupling elements having a pitch spacing;

an intermediate body fixedly attached to both the first stringer and the second stringer, the intermediate body interposing the two portions of each edge of the tapes of the first and second stringers;

a first slider being traversable along a longitudinal axis along a first of said two spaced portions of each of the edges of the tapes, movement of the first slider in one direction being configured to cause the coupling elements disposed along a first of said two spaced portions of each of the edges of the tapes to interdigitate with one another;

a second slider being traversable along the longitudinal axis along a second of said two spaced portions of each of the edges of the tapes, movement of the second slider in the one direction being configured to cause the coupling elements disposed along the second portion of each of the edges of the tapes to interdigitate with one another; and wherein the first and second stringers are separated by a first lateral distance in a first longitudinal portion, the first and second stringers are separated by a second lateral distance in a second longitudinal portion, the first lateral distance is a distance between the first and second stringers at a first end of the intermediate body, the second lateral distance is a distance between the first and second stringers at a second end of the intermediate body, and a transition portion extending along at least a portion of a longitudinal extent of the intermediate body interposes the first and second longitudinal portions, and the second lateral distance is greater than the first lateral distance.

2. The slide fastener according to claim 1, wherein the first and second stringers diverge in a lateral direction in the transition portion.

3. The slide fastener according to claim 1, wherein a maximum longitudinal extent of the intermediate body is greater than or equal to a distance equal to five pitch spacings.

4. The slide fastener according to claim 1, wherein the intermediate body comprises at least one cavity, said at least one cavity exposing a cord of at least one of the tapes.

5. The slide fastener according to claim 1, wherein the intermediate body comprises a plurality of cavities, said cavities exposing cords of the tapes of both the first stringer and the second stringer.

6. The slide fastener according to claim 1, wherein the intermediate body comprises a laterally recessed portion.

7. The slide fastener according to claim 1, wherein the intermediate body comprises a first end configured to abut a lower portion of the first slider, and the intermediate body comprises a second end configured to abut an upper portion of the second slider.

8. The slide fastener of claim 7, wherein the second end of the intermediate body comprises a groove in which at least part of a diamond of the second slider is receivable.

9. The slide fastener according to claim 7, wherein first and second tabs extend in a longitudinal direction from the second end of the intermediate body, and wherein the first and second tabs are configured to engage flanges and/or a diamond which define corresponding openings in the second slider.

10. The slide fastener of claim 9, wherein the first and second tabs have a reduced thickness relative to the rest of the intermediate body, the reduced thickness preferably being substantially equal to a thickness of the coupling elements of the second spaced set of coupling elements.

11. The slide fastener according to claim 1, wherein the intermediate body is manufactured from a material which has a lower Young's modulus value than that of a material from which the coupling elements are manufactured.

12. The slide fastener according to claim 1, wherein the slide fastener comprises two or more intermediate bodies.

13. An article comprising a slide fastener according to according to claim 1.

14. A slide fastener comprising:

first and second stringers, each of the first and second stringers comprising a tape and first and second spaced sets of coupling elements disposed along two spaced portions of an edge of the tape, each set of coupling elements having a pitch spacing;

an intermediate body fixedly attached to both the first stringer and the second stringer, the intermediate body interposing the two portions of each edge of the tapes of the first and second stringers;

a first slider being traversable along a longitudinal axis along a first of said two spaced portions of each of the edges of the tapes, movement of the first slider in one direction being configured to cause the coupling elements disposed along a first of said two spaced portions of each of the edges of the tapes to interdigitate with one another;

a second slider being traversable along the longitudinal axis along a second of said two spaced portions of each of the edges of the tapes, movement of the second slider in the one direction being configured to cause the coupling elements disposed along the second portion of each of the edges of the tapes to interdigitate with one another; and wherein a maximum longitudinal extent of the intermediate body is greater than or equal to a distance equal to five pitch spacings.

* * * * *